US007828296B2

(12) United States Patent
Crawley et al.

(10) Patent No.: US 7,828,296 B2
(45) Date of Patent: Nov. 9, 2010

(54) MULTI-SPORTS BALL/DISK RETURN NET SYSTEM AND METHOD THEREOF

(75) Inventors: Paul A. Crawley, Bergen County, NJ (US); Matthew J. Crawley, Horry County, SC (US)

(73) Assignee: The Net Return, LLC, Fair Lawn, NJ (US)

( * ) Notice: Subject to any disclaimer, the term of this patent is extended or adjusted under 35 U.S.C. 154(b) by 0 days.

(21) Appl. No.: 12/220,531

(22) Filed: Jul. 25, 2008

(65) Prior Publication Data

US 2009/0029805 A1 Jan. 29, 2009

Related U.S. Application Data

(63) Continuation-in-part of application No. 11/881,351, filed on Jul. 26, 2007, now Pat. No. 7,600,759.

(51) Int. Cl.
*A63B 63/00* (2006.01)

(52) U.S. Cl. ..... 273/396; 273/400; 473/434; 473/438; 473/432; 473/454; 473/478

(58) Field of Classification Search ..... 273/395–402; 473/476, 478, 434, 435, 454, 456
See application file for complete search history.

(56) References Cited

U.S. PATENT DOCUMENTS 1,540,670 A * 6/1925 Vidmer ..... 473/190
3,227,449 A * 1/1966 Scwab ..... 473/439
4,082,271 A * 4/1978 Martin ..... 473/435
D259,052 S * 4/1981 Gilman ..... D21/705
4,703,931 A * 11/1987 Steen ..... 473/435
4,723,780 A * 2/1988 Vinzetta ..... 473/197
4,786,053 A * 11/1988 Barnes, Jr. ..... 473/416
4,836,542 A * 6/1989 Crawley ..... 473/432
5,312,099 A * 5/1994 Oliver, Sr. ..... 473/433
5,472,212 A * 12/1995 Bercaw ..... 473/462
5,558,338 A * 9/1996 Taub ..... 473/416
6,929,569 B1 * 8/2005 Wang ..... 473/433
7,021,630 B1 * 4/2006 Cho ..... 273/401
7,600,759 B2 * 10/2009 Crawley et al. ..... 273/396
2006/0073919 A1 * 4/2006 Morrow ..... 473/434

* cited by examiner

*Primary Examiner*—Mark S Graham
(74) *Attorney, Agent, or Firm*—Gloria Tsui-Yip; Howard Miskin

(57) ABSTRACT

A multi-sports ball/disk return net system and a method thereof that consistently returns a ball/disk hit, kick, thrown or struck into it back toward a user and that is portable and easy to assemble and disassemble. The multi-sports ball/disk return net system has a frame and a net mounted on or across the frame. The net forms an upper U-shape forward bulging pillow having a square net pattern and a lower U-shape channel or hammock with the square pattern at the opposite ends of the U-shape channel being skewed to become diamond shapes. The net is configured to cause a projectile propelled into the U-shape pillow to drop down to the U-shape channel, which funnels the ball to the lowest and central point of the U-shape channel for discharge toward the user.

49 Claims, 18 Drawing Sheets

MULTI-SPORTS BALL/DISK RETURN NET SYSTEM AND METHOD THEREOF

CROSS-REFERENCE TO RELATED APPLICATION

This is a continuation-in-part application of pending U.S. patent application Ser. No. 11/881,351, filed on Jul. 26, 2007 now U.S. Pat. No. 7,600,759.

FIELD OF THE INVENTION

The invention relates to a multi-sports ball/disk return net system and method thereof. Specifically, it relates to an improved return net system with an improved net that is portable and returns a ball, disk or other sports projectile propelled into the net directly towards the user.

BACKGROUND OF THE INVENTION

For sports that use a ball/disk, it is common for a person to practice making contact with (i.e., by hitting, kicking, throwing or striking) the ball/disk to propel it in a direction. Repetition during practice helps achieve precision in making contact with the ball/disk in the proper manner to propel the ball/disk in a desired direction. To be able to practice hitting, kicking, throwing or striking a ball/disk, known systems typically require a user to constantly retrieve the ball/disk, so that it can be hit, kicked, thrown or struck repeatedly.

One way to achieve this is to have another person catch the ball/disk and return it to the hitter. Another way to achieve this is to utilize a net system. Certain known prior art net systems include a rectangular shaped frame with a net mounted across the frame. A ball/disk hit into the net is bounced back, usually not directly to the user unless the ball/disk hit the net at an angle exactly normal to the plane of the net. Therefore, a user of such prior art net system has to, disadvantageously, constantly move to different positions to catch or retrieve the returned ball/disk. Examples of such prior art systems are disclosed in U.S. Pat. Nos. 4,905,996 and 5,269,527.

Other known prior art net systems utilize a net that is configured into a pocket shape to collect balls, which may then be returned to the user via formed chutes. The need for extraneous structures and parts, such as chutes, disadvantageously make such prior art system difficult to transport or assemble. Examples of such prior art systems are disclosed in U.S. Pat. Nos. 2,805,070 and 6,620,064.

In general, known prior art net systems disadvantageously require a specific system for each different type of sport. Most prior art net systems have nets with holes that are sized to specific sports. For example, certain such nets include ⅞" holes for golf, 4" holes for soccer, or 1-⅛" holes for lacrosse and baseball. Also, most prior art net systems utilize lightweight net that is not appropriate for use with multiple different types of sports balls/disks.

Therefore, there is a need for a portable multi-sports ball/disk return net system which can be easily assembled and transported and which returns a ball, disk or other sports projectile to a user, such that minimal or no effort by the user is required to retrieve the returned ball/disk/projectile.

SUMMARY OF THE INVENTION

The present invention provides a multi-sports ball/disk return net system with an improved net and a method thereof which consistently returns a ball, disk or other projectile that is hit, kick, thrown or struck into it directly to a user and which is portable and easy to assemble and disassemble.

The multi-sports ball/disk return net system of the present invention comprises a frame and a net mounted on or across the frame. The net forms an upper U-shape forward bulging pillow and a lower U-shape channel or hammock. A ball/disk propelled into the U-shape pillow drops down to the U-shape channel, which funnels the ball to the lowest and central point of the U-shape channel for discharge toward the user.

The frame of the multi-sports ball/disk return net system comprises a plurality of substantially straight interconnectable tubular members. When the tubular members are connected, they form an upstanding frame having a S-shape side profile. The plurality of tubular members of the frame includes an upper front transverse member, each end of which is configured to be connected to an upper rearwardly extending horizontal member, each distal end of which is configured to be connected to an upper downwardly extending vertical member, each distal end of which is configured to be connected to an intermediate downwardly extending and forwardly inclined member, each distal end of which is configured to be connected to a lower downwardly extending vertical member, each distal end of which is configured to be connected to a lower rearwardly extending horizontal member, each distal end of which is configured to be connected to one of the two ends of a lower rear transverse member.

One embodiment of the net of the multi-sports ball/disk return net system has a substantially isosceles trapezoidal shape. The longer parallel edge of the net is sleeved on or across the upper front transverse member and the pair of upper horizontal members. Each side edge of the net is sleeved over one of the pair of upper vertical members, intermediate inclined members and lower vertical members.

Another embodiment of the net of the multi-sports ball/disk return net system has a generally bread shape with a wider upper bulging portion, a wider lower rectangular portion and a narrower tapered middle portion. The upper portion is wider than the lower portion. The upper and lower edges are substantially parallel to each other and are substantially the same width, with the upper parallel edge being sleeved across the upper front transverse member. The wider upper portion is sleeved across the upper horizontal members and upper vertical members. The middle narrower portion is sleeved across the intermediate inclined members and lower vertical members.

The multi-sports ball/disk return net system of the present invention can be used to consistently return balls, disks or other sports projectiles to the user in such sports as golf, football (punting and place-kicking), soccer, baseball (hitting and pitching), softball (hitting and pitching), lacrosse, street hockey, basketball, volleyball, badminton, tennis, field hockey, ice hockey, roller hockey, racket ball, handball, table tennis, bocce ball, rugby, squash, cricket, jai alai, paddle ball, discus throwing or shot put, or any other sport employing balls, disks, or other projectiles.

BRIEF DESCRIPTION OF THE DRAWINGS

Preferred embodiments of the present invention have been chosen for purposes of illustration and description and are shown (not to scale) in the accompanying drawings forming a part of the specification wherein.

DETAILED DESCRIPTION OF THE PREFERRED EMBODIMENTS

Figure 1:
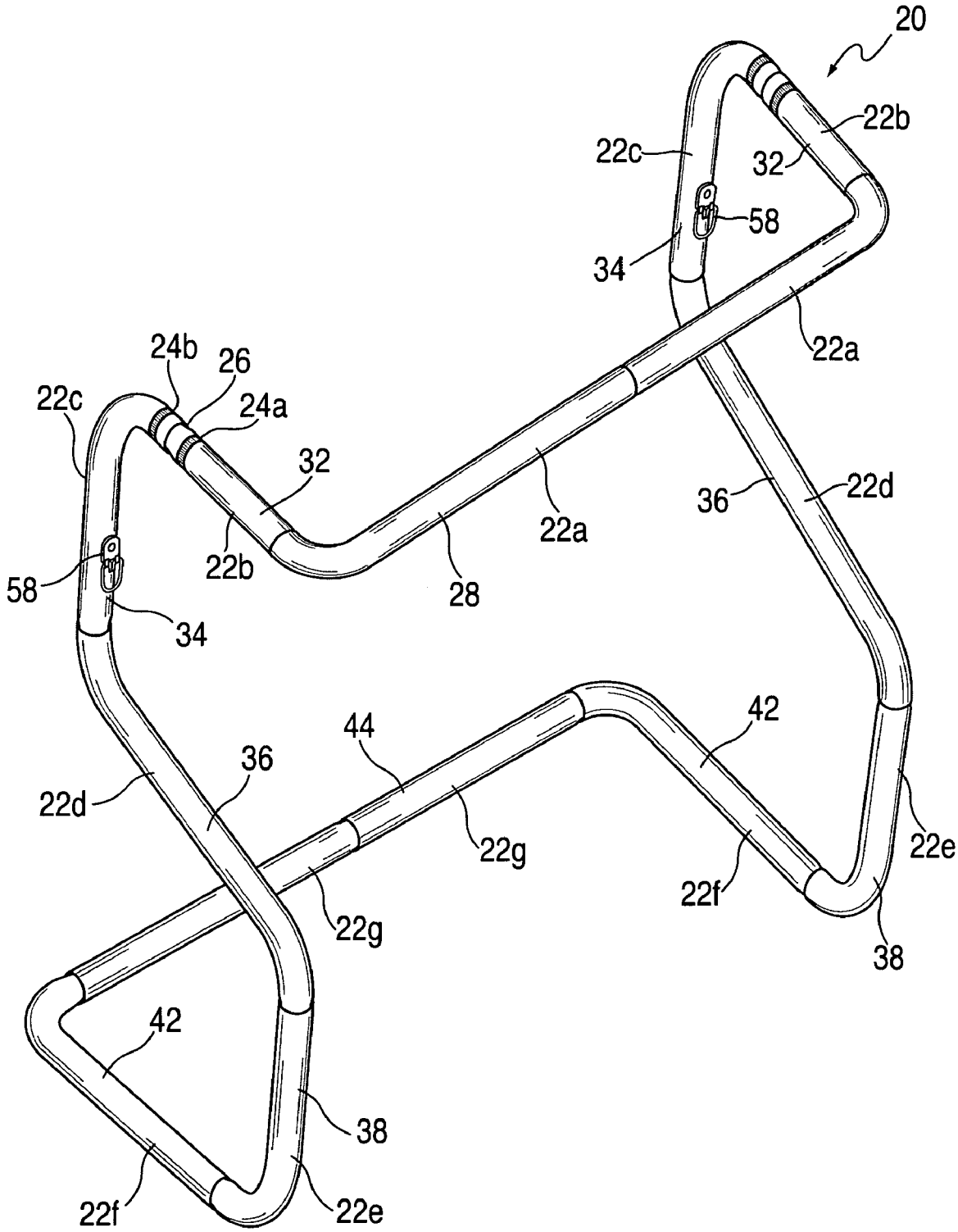
FIG. 1 shows a top perspective view of the frame of the multi-sports ball/disk return net system of one embodiment of the present invention.

With reference to the drawings wherein the same reference number illustrates the same element throughout, FIG. 1 shows the frame 20 of the multi-sports ball/disk return net system 10 of the present invention.

As shown in FIG. 1, the frame 20 of the multi-sports ball/disk return net system 10 is constructed from a plurality of interconnectable tubular elements 22. The embodiment shown in FIG. 1 has fourteen (14) tubular elements 22—two of each tubular element 22*a*, 22*b*, 22*c*, 22*d*, 22*e*, 22*f*, and 22*g*. The tubular elements 22 may be made of a light weight material such as aluminum, plastic or polyvinyl chloride (PVC), or any other suitable material. Each tubular element 22 may have one tapered end for fitting into another tubular element's 22 non-tapered end. The tubular elements 22 may be interconnected by any method known to connect tubular elements, such as snap fitting or frictional fitting. The tubular elements 22 may also be interconnected with the use of a pushbutton on the tapered end with a corresponding opening on the non-tapered end.

To further facilitate assembly of the frame 20, the corresponding ends of each pair of tubular elements 22 at each point of interconnection have matching color codes or bands, as illustrated by matching color bands 24*a* and 24*b* at point of interconnection 26. The color coding of the tubular elements 22 allow a user to simply join the tubular elements 22 having matching colors (e.g. red to red, blue to blue, etc.) to form an interconnection. For the embodiment shown in FIG. 1, fourteen (14) color codes or bands are required (not shown). Other types of matching indicia can be used to facilitate matching the tubular elements 22 to form an interconnection.

The color coding of the tubular elements 22 at the points of interconnection facilitate the assembly and disassembly of the frame 20 of the multi-sports ball/disk return net system 10 to make it easily and quickly transportable to different locations. It takes approximately five (5) minutes to assemble the frame 20 as shown in FIG. 1.

The interconnectable tubular elements 22 are assembled, as shown in FIG. 1, to form the frame 20. The two tubular elements 22*a* are interconnectable to form the upper front transverse member 28; each distal end of the two tubular elements 22*a* is interconnectable with a tubular element 22*b* to form a pair of parallel upper rearwardly extending horizontal members 32; each distal end of the two tubular elements 22*b* is interconnectable with a tubular element 22*c* to form a pair of parallel upper downwardly extending vertical member 34; each distal end of the two tubular elements 22*c* is interconnectable with a tubular element 22*d* to form a pair of parallel intermediate downwardly extending and forwardly inclined member 36; each distal end of the two tubular elements 22*d* is interconnectable with a tubular element 22*e* to form a pair of parallel lower downwardly extending vertical member 38; each distal end of the two tubular elements 22*e* is interconnectable with a tubular element 22*f* to form a pair of parallel lower rearwardly extending horizontal member 42; the two tubular elements 22*g* are interconnectable to form the lower rear transverse member 44; each distal end of the two tubular elements 22*f* is interconnectable with one of the ends of the formed lower rear transverse member 44.

Figure 5:
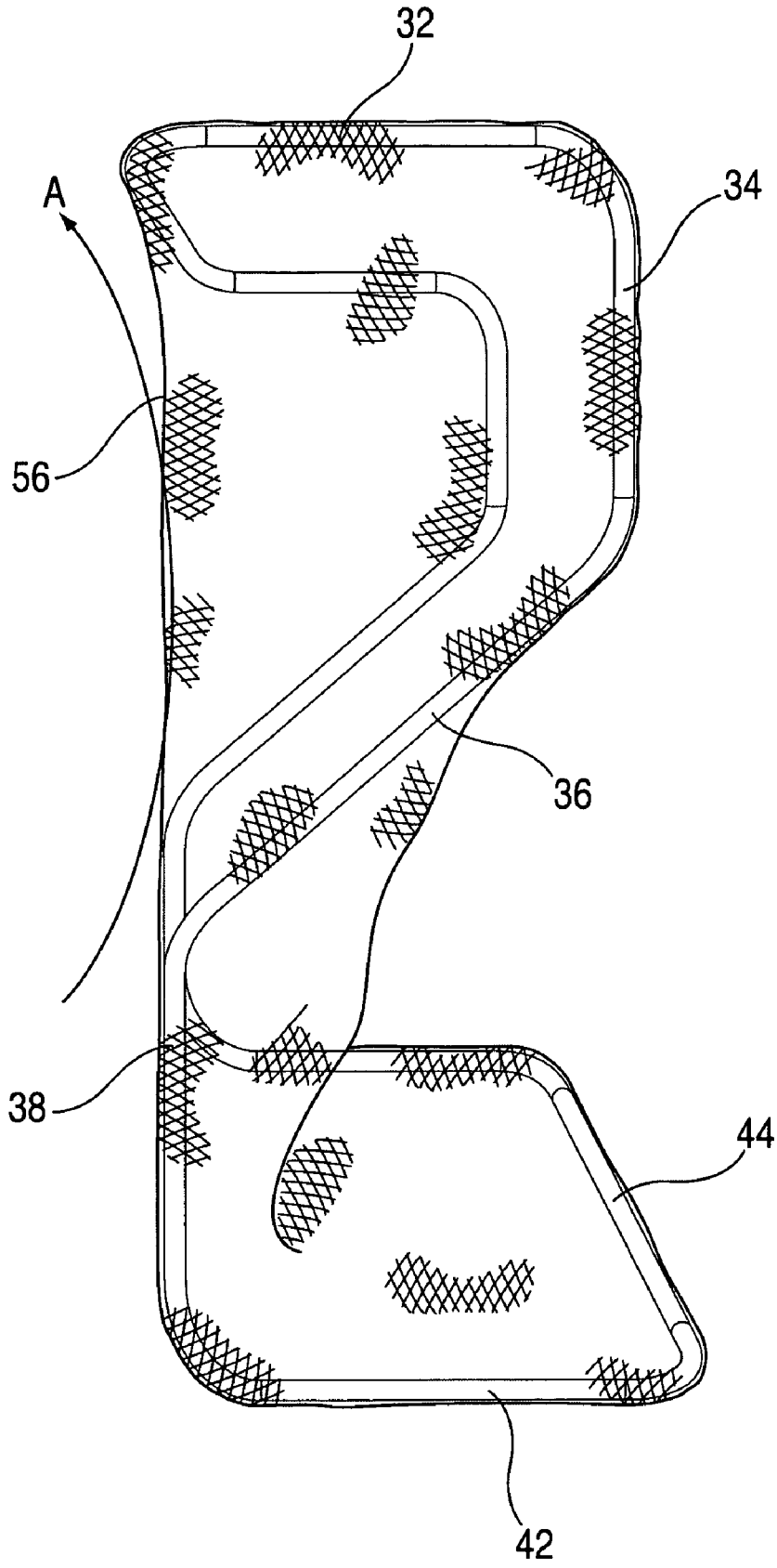
FIG. 5 shows a side view of the multi-sports ball/disk return net system of one embodiment of the present invention.

As shown in FIG. 5, frame 20 has a S-shape side profile. The upper front transverse member 28 is in substantial vertical alignment with the lower vertical member 38 and the lower rear transverse member 44 is in substantial vertical alignment with the upper vertical member 34. This configuration allows the frame 20 to be self-supporting without any additional mounting or stabilizing elements. However, it should be appreciated that one or more stabilizing elements or weights, such as sandbags, may be employed to add further stability to the frame 20.

The frame 20 can have various dimensions, depending on the type of sports the ball return net system 10 is used for and the space or location where the ball return net system 10 is being used. The embodiment shown in FIGS. 1 and 3 has a width of eight feet (8'), height of seven feet five inches (7'5") and a depth of thirty-eight inches (38"). In such an embodiment, if lightweight aluminum tubular elements 22 that are one and a half inch (1.5") in diameter are used, the frame 20 weighs approximately twenty pounds (20 lbs). When disassembled, the tubular elements 22 can easily fit in a bag of approximately fifty-five inches (55") in length and twelve inches (12") in diameter, thus making the net return system 10 easily transportable.

Figure 2:
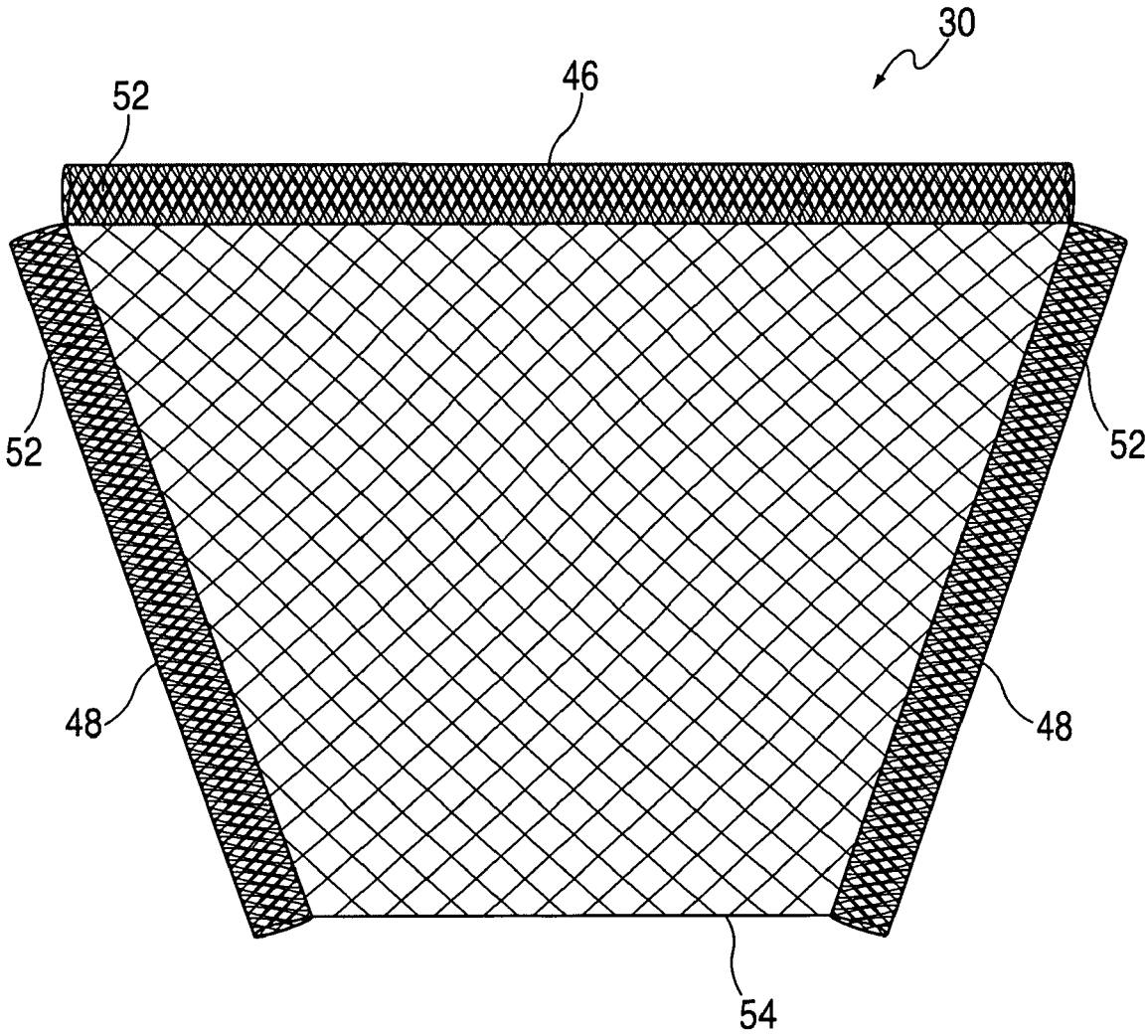
FIG. 2 shows a front view of the net of the multi-sports ball/disk return net system of one embodiment of the present invention.

FIG. 2 shows one embodiment of the net 30 of the multi-sports ball/disk return net system 10 of the present invention.

The net 30 has a substantially isosceles trapezoidal shape. Each of the longer parallel edge 46 and the side edges 48 of the net 30 has a sleeve 52 for mounting the net 30 onto the frame 20.

Figure 3:
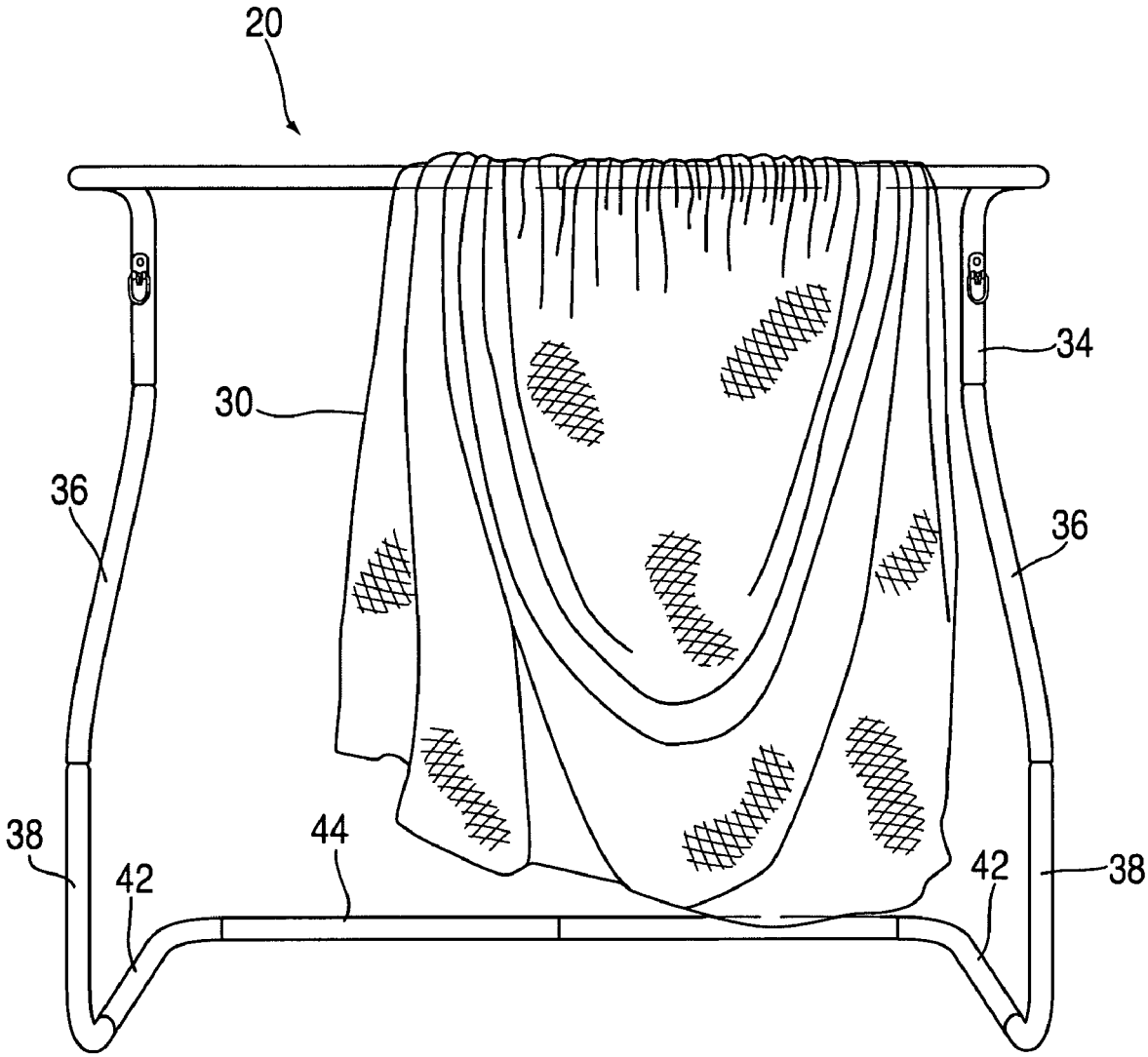
FIG. 3 shows a front view of the net compacted on the upper front transverse member during assembly of the multi-sports ball/disk return net system of one embodiment of the present invention.

The width of the longer parallel edge 46 of the net 30 is the same or slightly longer than the total length of the upper front transverse member 28 and the pair of parallel upper horizontal members 32. The height of the net 30 is greater than the height of the frame 20. For the frame 20 as shown in FIGS. 1 and 3, the net 30 has a width of thirteen feet (13') at the longer parallel edge 46, a width of nine feet (9') at the shorter parallel edge 54 and a height of twelve feet (12'). The dimensions of the net 30 can vary correspondingly with the dimensions of the frame 20. The degree of tapering of the trapezoidal shape of the net 30 can vary and will result in slightly different ball return net systems 10, as will be discussed below. In an embodiment which employs tubular elements 22 that are one and a half inches (1.5") in diameter, the sleeve 48 may be six inches (6") wide to allow unhindered movement along the tubular elements 22 of the frame 20.

The pattern and gauge of the net 30 may vary depending on the type and size of the ball the return net system 10 is used for. For example, diamond, triangle, square, other polygonal or non-polygonal shapes, etc. A heavier gauged net 30 provides a stronger arresting force to a ball propelled, hit, or struck into the net 30. As an alternative to using a heavier gauge net 30, small weights may be hung on the lower portion of the net 30.

As illustrated in FIG. 3, to mount the net 30 onto the frame 20, the sleeves 52 of the longer parallel edge 46 and side edges 48 are compacted and slipped over the upper front transverse member 28. Then the remaining members 32, 34, 36, 38, 42 and 44 of the frame 20 are interconnected to form frame 20. After the frame 20 is assembled, the net 30 is mounted across the frame 20 such that the sleeve 52 of the longer parallel edge 46 is sleeved onto the upper front transverse member 28 and the pair of upper horizontal members 32 and each sleeve 52 of the side edges 48 is sleeved onto an upper vertical member 34, an intermediate inclined member 36 and a lower vertical member 38. In one embodiment, shorter parallel edge 54 gathers on the floor, ground, or surface on which the ball return net system 10 sits and is placed or lays towards the lower rear transverse member 44.

Figure 4:
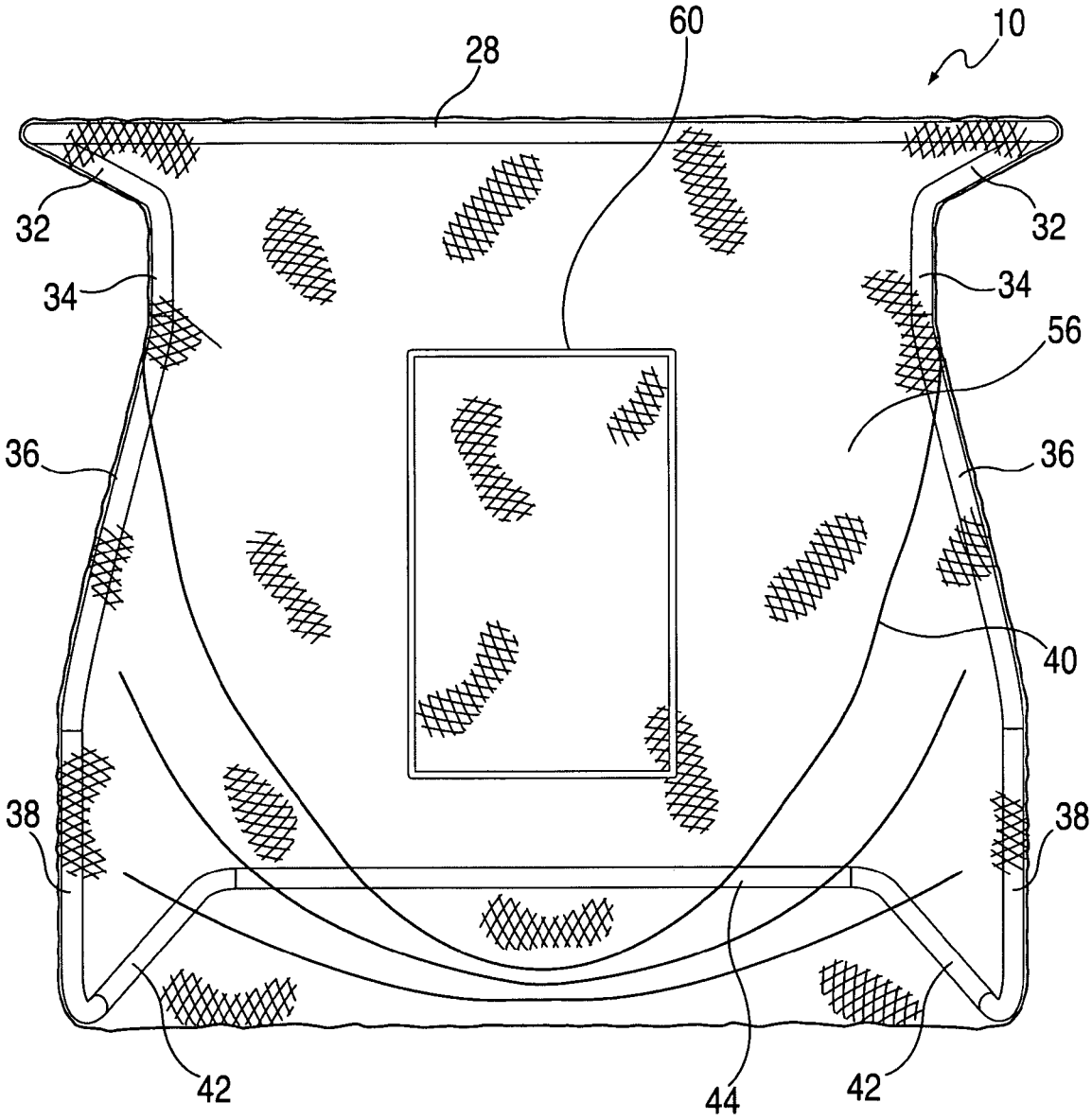
FIG. 4 shows a front view of the multi-sports ball/disk return net system of one embodiment of the present invention.
Figure 6:
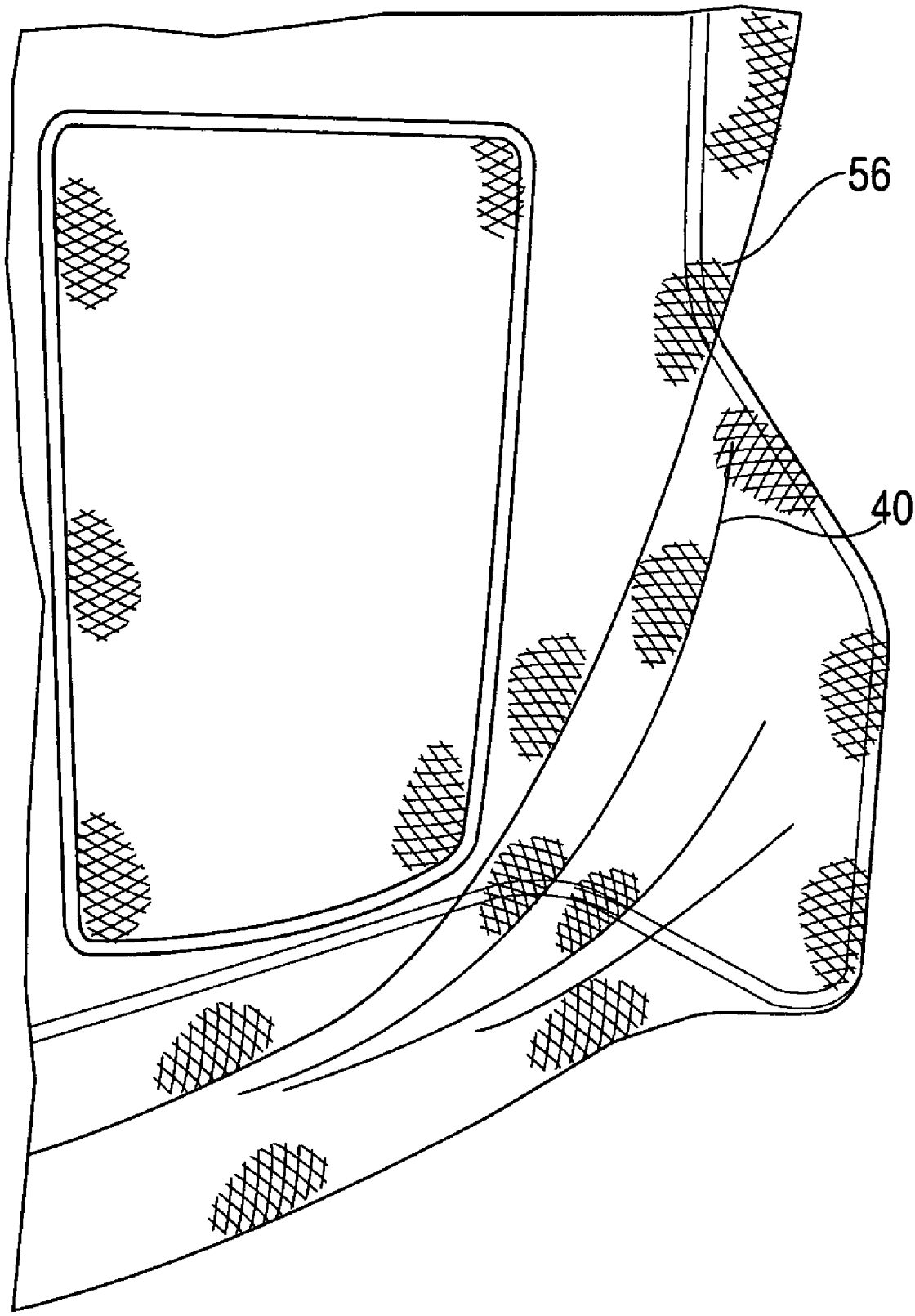
FIG. 6 shows a detail view of the U-shape channel formed on the net of one embodiment of the multi-sports ball/disk return net system of the present invention.

FIGS. 4, 5 and 6 show the ball return net system 10 with the net 30 mounted on the frame 20. It should be appreciated that, in the illustrated embodiment, net 30 is not tautly mounted on or across the frame 20. Due to the sizes and configurations of the frame 20 and the net 30, the net 30 is loosely hung on the frame 20 and forms a U-shape channel or hammock 40 across the pair of intermediate inclined members 36. Above the U-shape channel 40 and below the upper front transverse member 28 is a U-shape forward bulging pillow 56. The U-shape pillow 56 defines the impact zone of the ball return net system 10 and the U-shape channel 40 defines the ball return zone of the ball return net system 10. In certain embodiments, a target 60 may be provided or marked on the net 30 as a feedback tool for a user practicing consistent striking, hitting or kicking of a ball or other sports projectile into the target 60. The target 60 may be sewed or painted onto any suitable area of the net 30. Further, the target 60 can by any shape, size and color.

Figure 7:
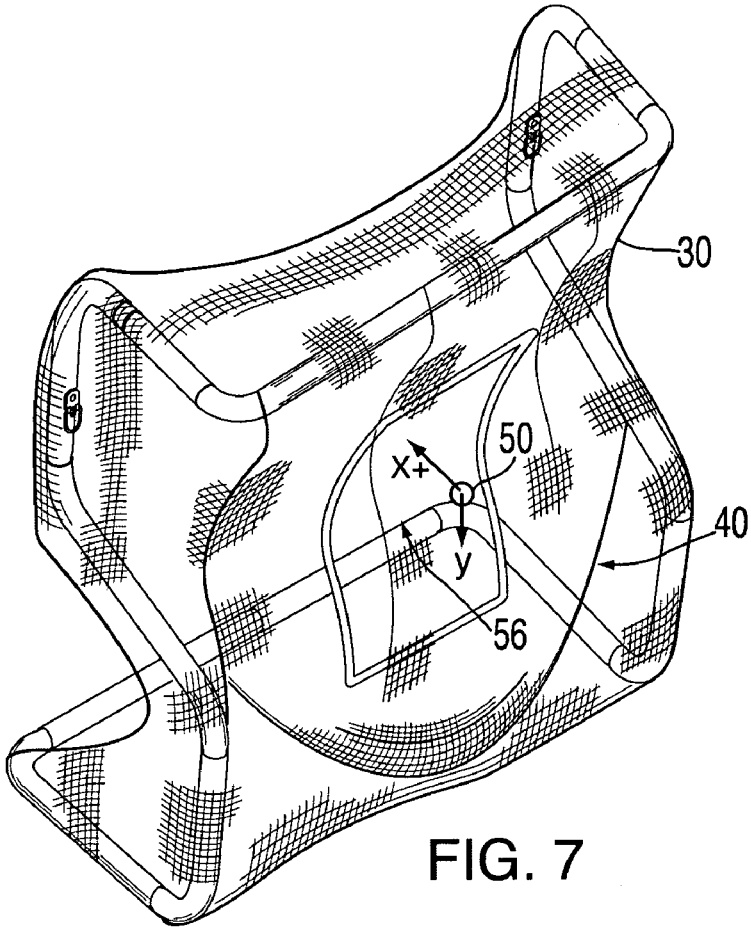
FIGS. 7 and 8 show the sequence of a ball hitting into and being returned by the net of the ball/disk return net system of one embodiment of the present invention.
Figure 8:
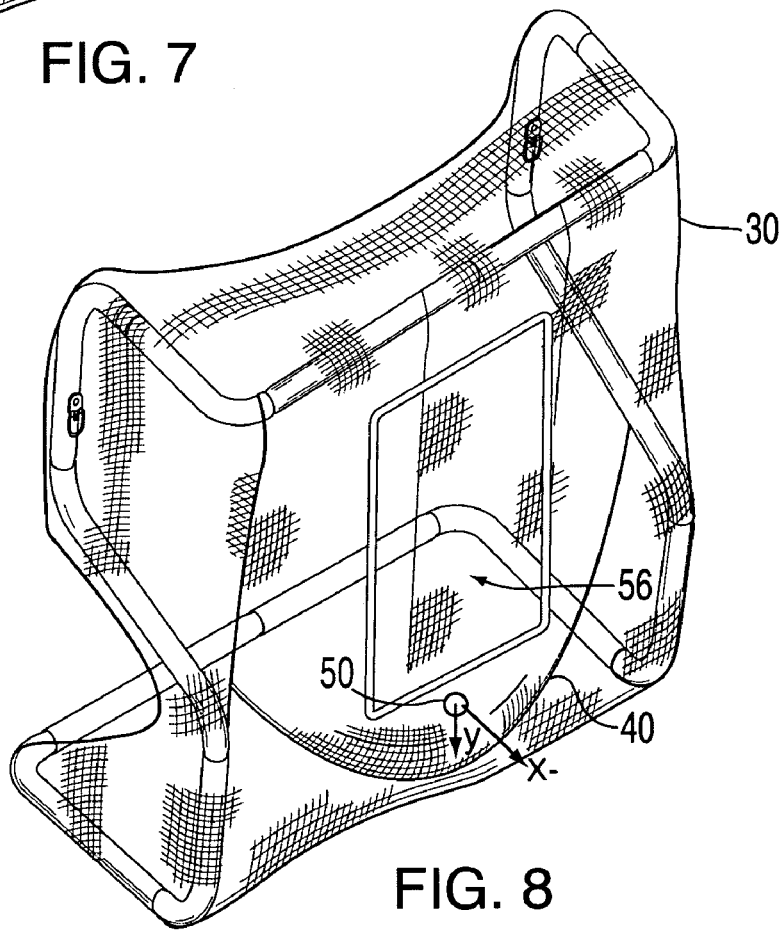

As shown in FIGS. 7 and 8, when a ball 50 is hit into the U-shape pillow 56 which defines the impact zone of the net 30, the U-shape pillow 56 moves backward in the direction X+ from the original vertical position (see FIG. 5) prior to impact. The net 30 absorbs the energy of the moving ball 50 to arrest its forward motion in the direction of X+. As the net 30 returns to its original position prior to the impact of the ball 50, the net 30 pushes the ball 50 in the direction of X−. The ball 50 rolls down towards the U-shape channel 40 (ball return zone) in the direction of Y. When the ball 50 reaches the lowest and central point of the U-shape channel 40, the ball 50 is released from the net 30. The combined forces in the X− and Y directions caused by the swinging/rocking of the net 30 and gravity, respectively, cause the ball 50 to have sufficient momentum and energy to roll directly towards the user who hits, strikes, kicks the ball 50 into the net 30. The spinning return of the ball 50 as a result of the forces in the X− and Y directions enhance the speed and distance of the returned ball 50.

A ball 50 hit into the U-shape pillow 56 which defines the impact zone of the net 30, regardless of whether it is centered or off-centered, rolls down towards the U-shape channel 40 (whether centrally or left or right sides of the U-shape channel), which then funnels or directs the ball 50 towards the lowest and central point of the U-shape channel 40 for consistent release and return of the ball 50 to the user in front of the net 30. Thus, a ball 50 is not randomly returned as in the prior art.

A ball 50 hit into the U-shape channel 40 similarly funnels the ball 50 towards the lowest and central point of the U-shape channel 40 for return to the user. A ball 50 striking the net 30 below the U-shape pillow 56 which defines the impact zone and the U-shape channel 40 may become trapped in the net 30 gathered on the ground or surface below the U-shape channel 40. This prevents the ball 50 from exiting the back of the net 30 and becoming a dangerous trajectory.

Figure 9:
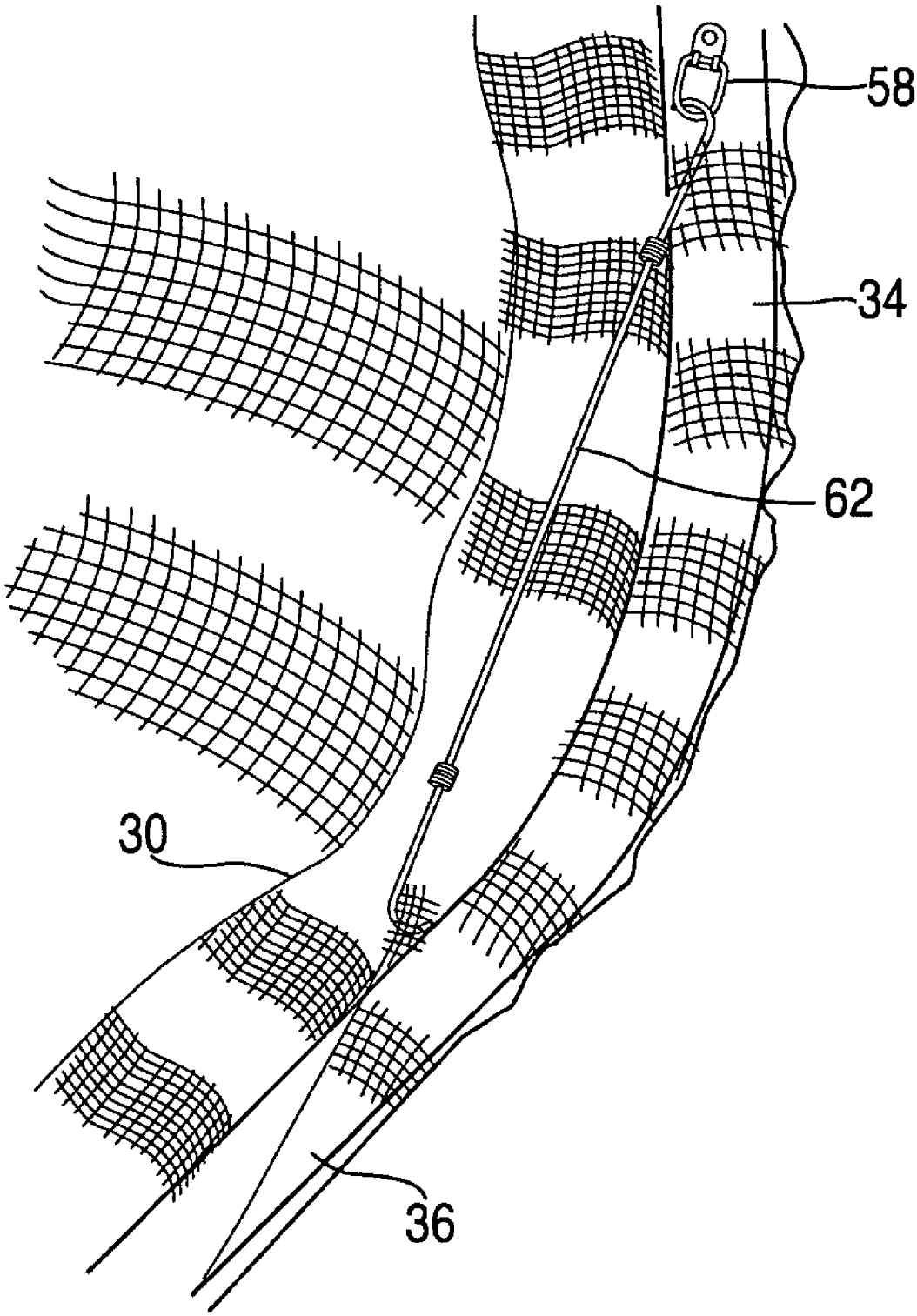
FIG. 9 is a detail view showing the raising of the U-shape channel with hook and cord.

In one embodiment, the U-shape channel 40 of the net 30 may be adjusted and fine-tuned to accommodate different balls and/or achieve different return effects. The depth of the U-shape channel 40 may be adjusted by varying the ratio between the longer parallel edge 46 and the shorter parallel edge 54 of the net 30. For example, a smaller ratio between the longer parallel edge 46 and the shorter parallel edge 54 provides a deeper U-shape channel 40. The lowest point of the U-shape channel 40 may be one inch (1") to eighteen inches (18") off the ground or other surface that supports the return net system 10 by varying the dimensions of the net 30 or by raising the U-shape channel 40. The U-shape channel 40 may be raised by providing a hook 58 (as shown on FIG. 1) on the upper vertical member 34 of the frame 20 so that a cord 62 connected to the hook 58 may be used to pull the sleeve 52 of the side edge 48 of the net 30 upward along the intermediate inclined member 36 of the frame 20, as shown in FIG. 9. By raising the lowest point of the U-shape channel 40 higher above the ground or other surface that supports the return net system 10, this allows a ball 50 exiting the U-shape channel 40 to drop to the ground to create a bounce, for the return of a larger ball such as a soccer ball. For the return of smaller balls, such as golf balls, where a rolling return is preferred to a bouncing return, the lowest point of the U-shape channel 40 may be set closer to the ground to avoid such a bounce.

Figure 10:
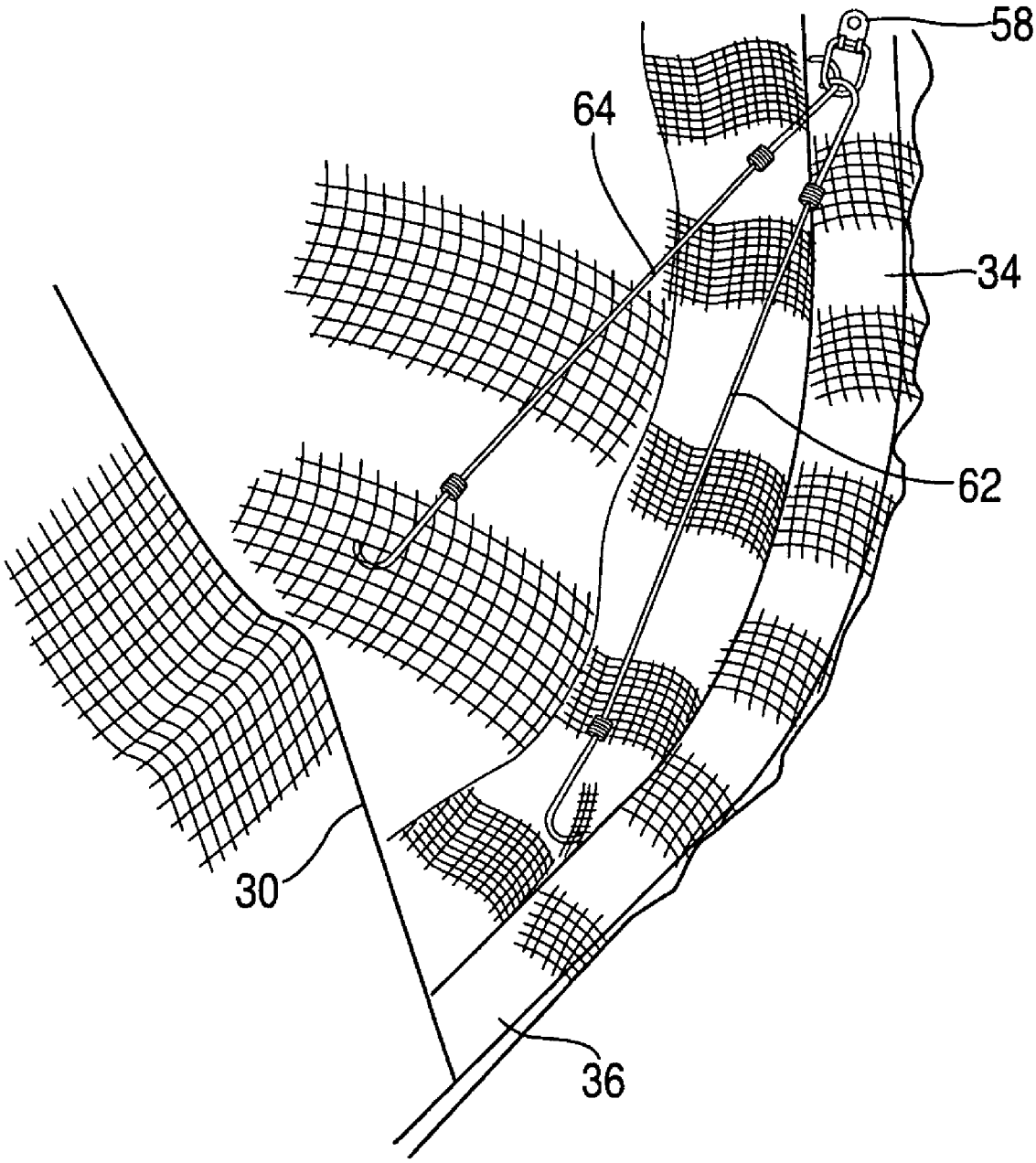
FIG. 10 is a detail view showing the angling of the impact zone with hook and cord.
Figure 11:
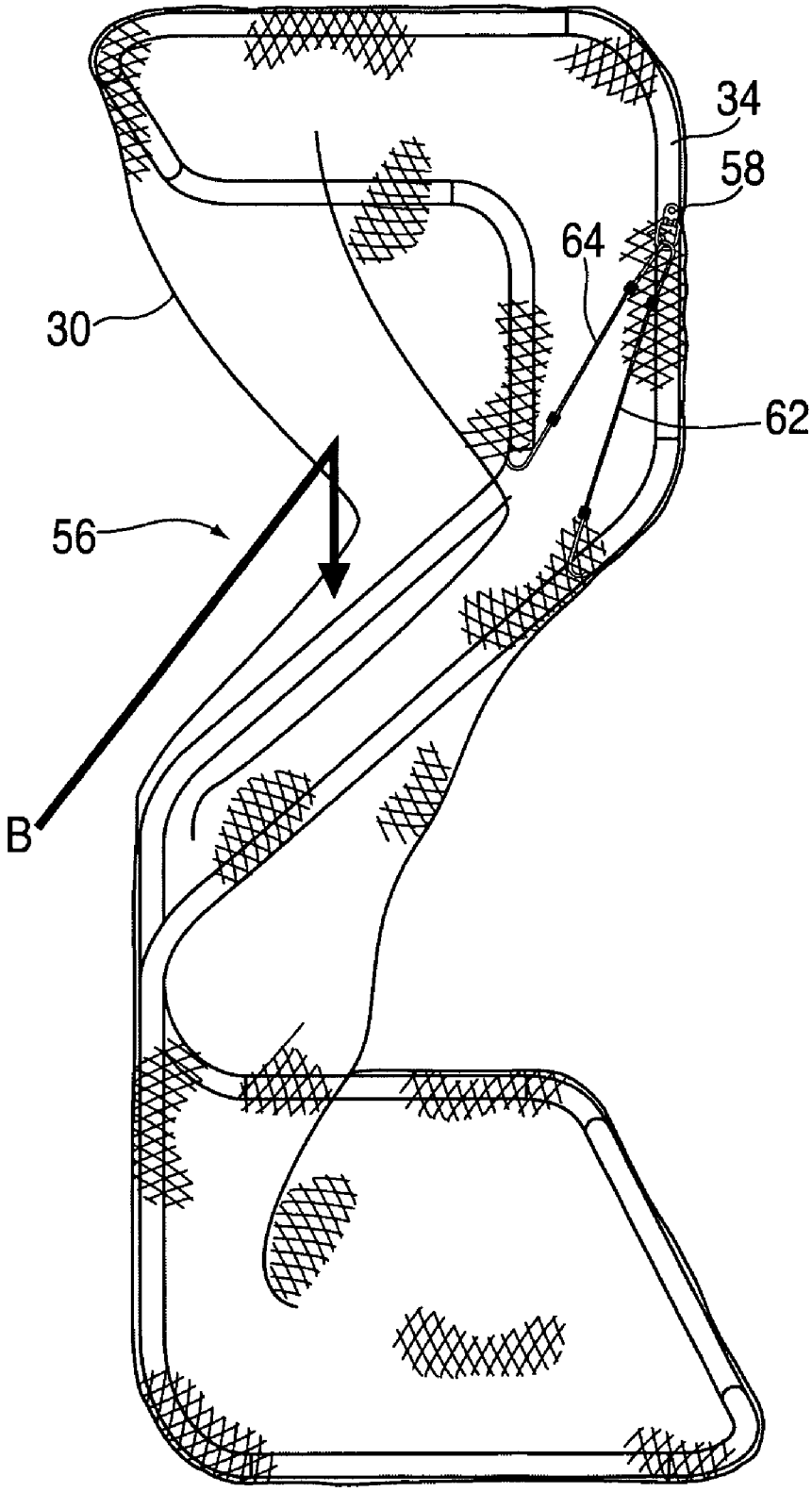
FIG. 11 is a side view of the multi-sports ball/disk return net system of one embodiment of the present invention with an angled impact zone.

The impact zone defined by the U-shape pillow 56 of the net 30 may also be adjusted and fine-tuned for different balls and to achieve different return effects. As shown in FIGS. 10 and 11, the impact zone may be angled backward by using a cord 64 connected to the hook 58 to pull back the impact zone of the net 30, at a nearly forty-five degree (45°) angle. Different angles can be achieved by pulling back from different points of the impact zone of the net 30. Angling the impact zone of the net 30 prevents a ball that travels at a near vertical upward angle from skimming over and skipping off the surface of the net 30 and not being returned to the user, as illustrated by arrow A in FIG. 5. By providing an angled impact zone, a ball 50 hit into it allows the net 30 to absorb the energy and arrest the movement of the ball 50 before rolling down to the U-shape channel 40 for return of the ball 50, as illustrated by arrow B in FIG. 11. An angled impact zone works well with a user driving a golf ball 50 with a sand wedge or 9 Iron that produces a significant loft to the ball 50.

The shorter parallel edge 54 of the net 30 may be completely raised above ground to create a deeper U-shape channel 40 with the use of cord 62 connected to the hook 58. By pulling the lower end of sleeve 52 of side edge 48 of the net 30 upward along the intermediate inclined member 36 of the frame 20, the U-shape channel 40 forms a pocket above ground that collects balls 50 hit into the net 30. The creation of such a pocket is advantageous when the ground is wet or muddy.

FIGS. 12, 13, 14, 15, 16, 17, 18, and 19 show another embodiment of the multi-sports ball/disk return net system 100 having a frame 200 and a net 300. The frame 200 is constructed from a plurality of interconnectable tubular elements 22*a*, 22*b*, 22*c*, 22*d*, 22*e*, 22*f*, and 22*g* as in frame 20, but with modifications to tubular elements 22*e* and 22*f*.

Figure 15:
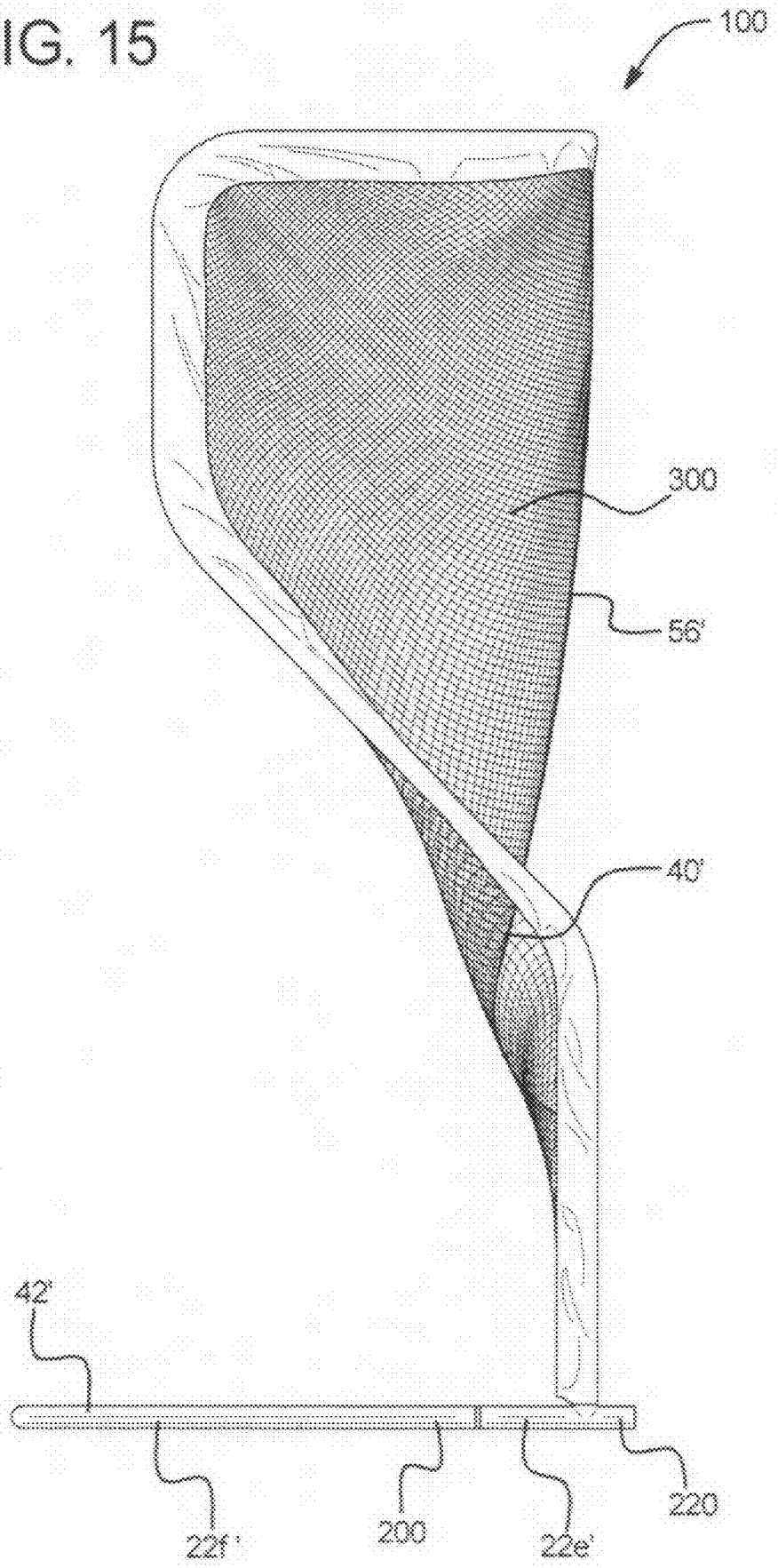
FIG. 15 shows a side view of the multi-sports ball/disk return net system of FIG. 12.

As shown in FIG. 15, frame 200 has a pair of tubular elements 22*f*' that are longer in length than tubular elements 22*f* of frame 20. The longer length of tubular elements 22*f*' result in a return net system 100 which has parallel lower horizontal members 42' that are longer than the parallel upper horizontal members 32. The longer or extended parallel lower horizontal members 42' provide additional rearward stability to the return net system 100 when a ball/disk 50' impacts the net 300.

Figure 16:
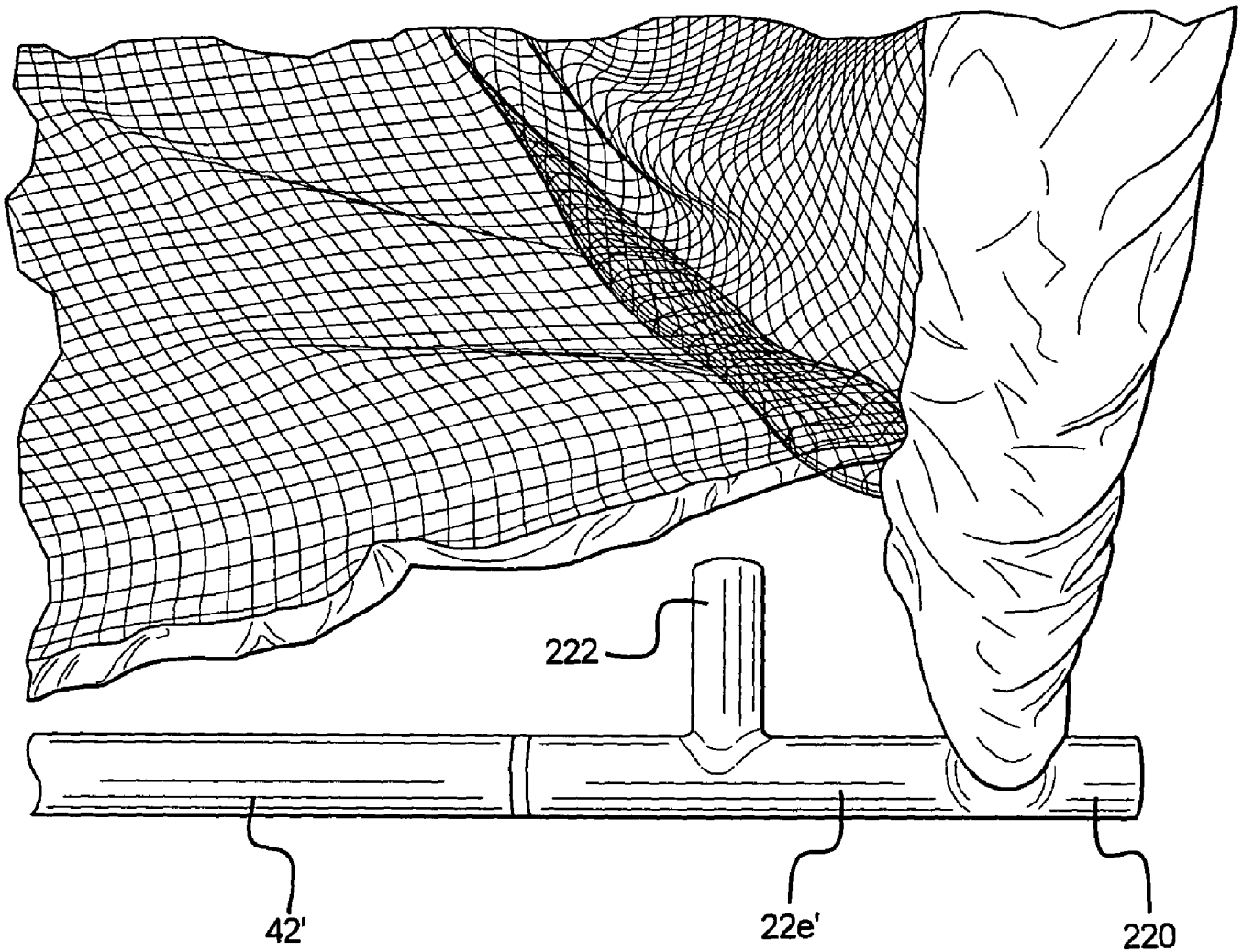
FIG. 16 shows a detailed side perspective view of the additional stabilizing members of the frame of the multi-sports ball/disk return net system of FIG. 12.

As shown in detail in FIG. 16, frame 200 has a pair of tubular elements 22*e*' instead of 22*e* of frame 20, with each tubular element 22*e*' having a forwardly extending horizontal element 220 and a transversely extending horizontal element 222. Both the forwardly extending horizontal element 220 and the transversely extending horizontal element 222 abut the ground or surface on which the multi-sports ball/disk return net system 100 is placed or supported. The forwardly extending horizontal element 220 provides additional forward stability to the return net system 100 when the weight of the net 300 travels forward when it first returns the ball/disk 50' immediately after impact. The transversely extending horizontal element 222 provides additional support and reduces swaying of the frame 200. For example, for a frame 200 that has a width of eight feet (8'), height of seven feet five inches (7'5") and a depth of thirty-eight inches (38"), the forwardly extending horizontal element 220 may be two inches (2") in length, and the transversely extending horizontal element 222 may be four inches (4") in length. Sandbags or other suitable weights may be placed on the transversely extending horizontal element 222 to insure that the return net system 100 is stable even in windy conditions.

Figure 12:
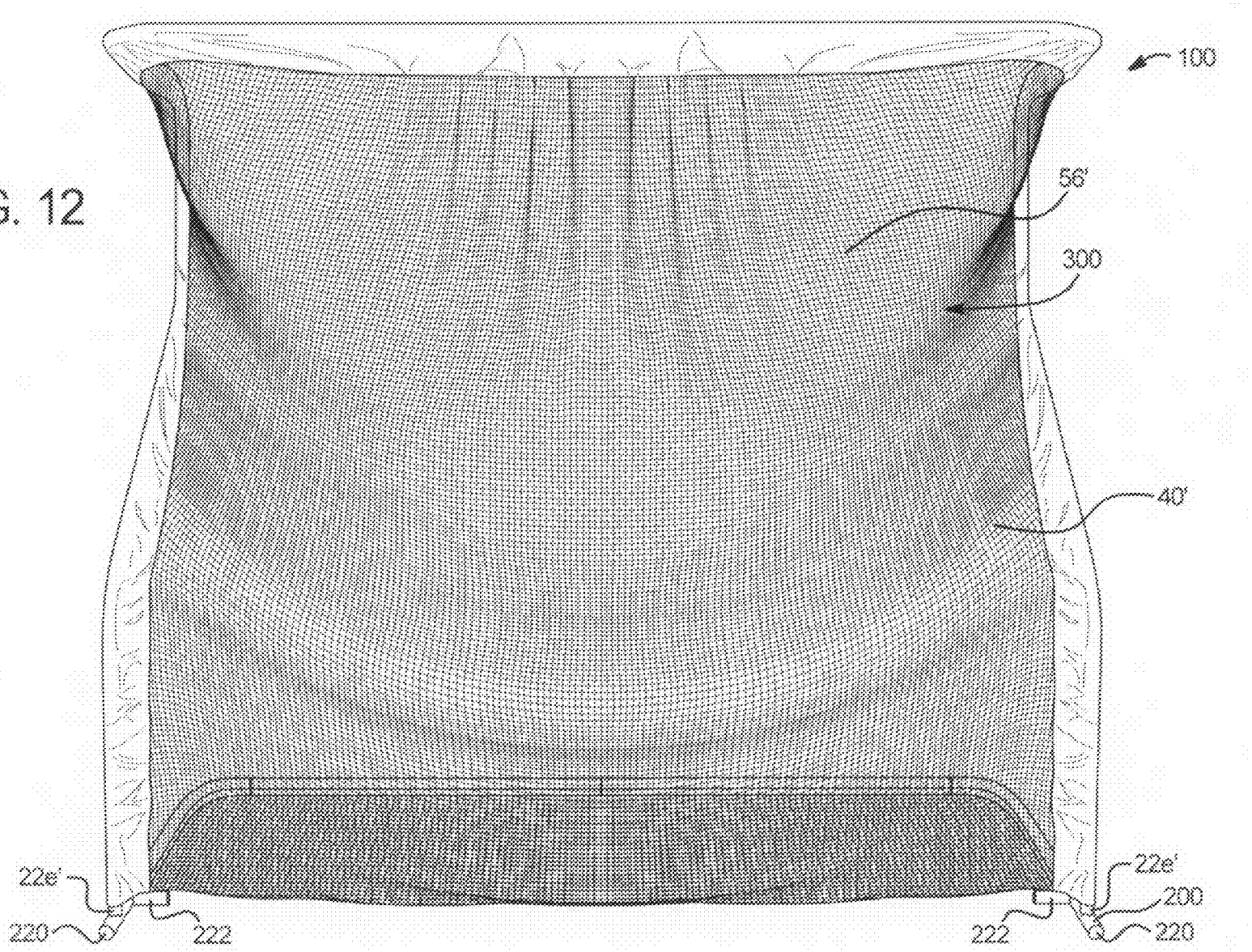
FIG. 12 shows a front view of another embodiment of the multi-sports ball/disk return net system of the present invention.
Figure 13:
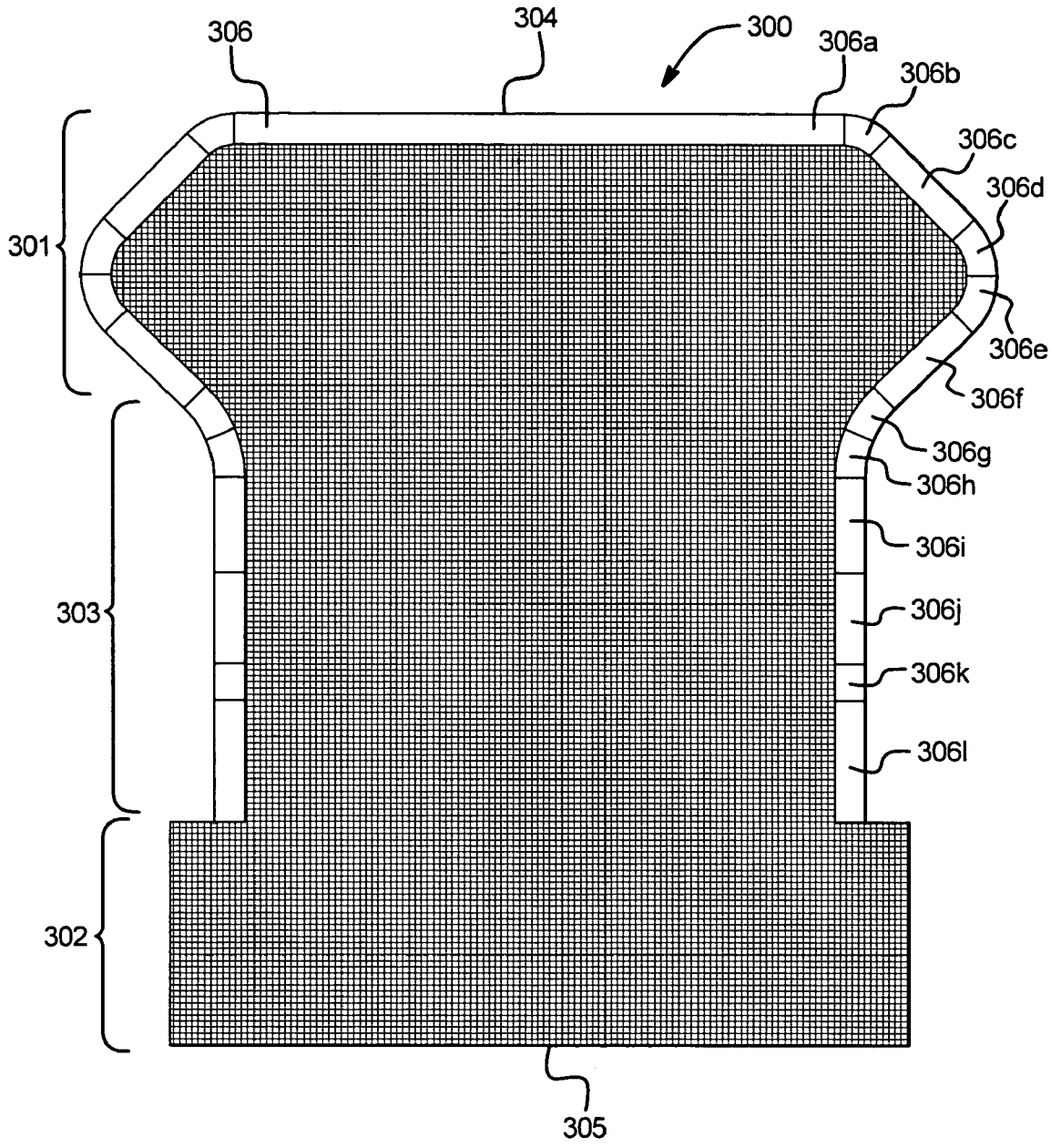
FIG. 13 shows a front view of the net of the multi-sports ball/disk return net system of FIG. 12.

FIG. 13 shows the net 300 of the embodiment of the multi-sports ball/disk return net system 100 of FIG. 12. In the illustrated embodiment, the net 300 has a generally bread shape, with a wider upper bulging portion 301, a wider lower rectangular portion 302 and a narrower tapered middle portion 303. The upper portion 301 is wider than the lower portion 302. The upper edge 304 and lower edge 305 are substantially parallel to each other and are substantially the same width. Along the perimeter of the upper portion 301 and narrower middle portion 303, including the upper edge 304, is a continuous sleeve 306.

Figure 14:
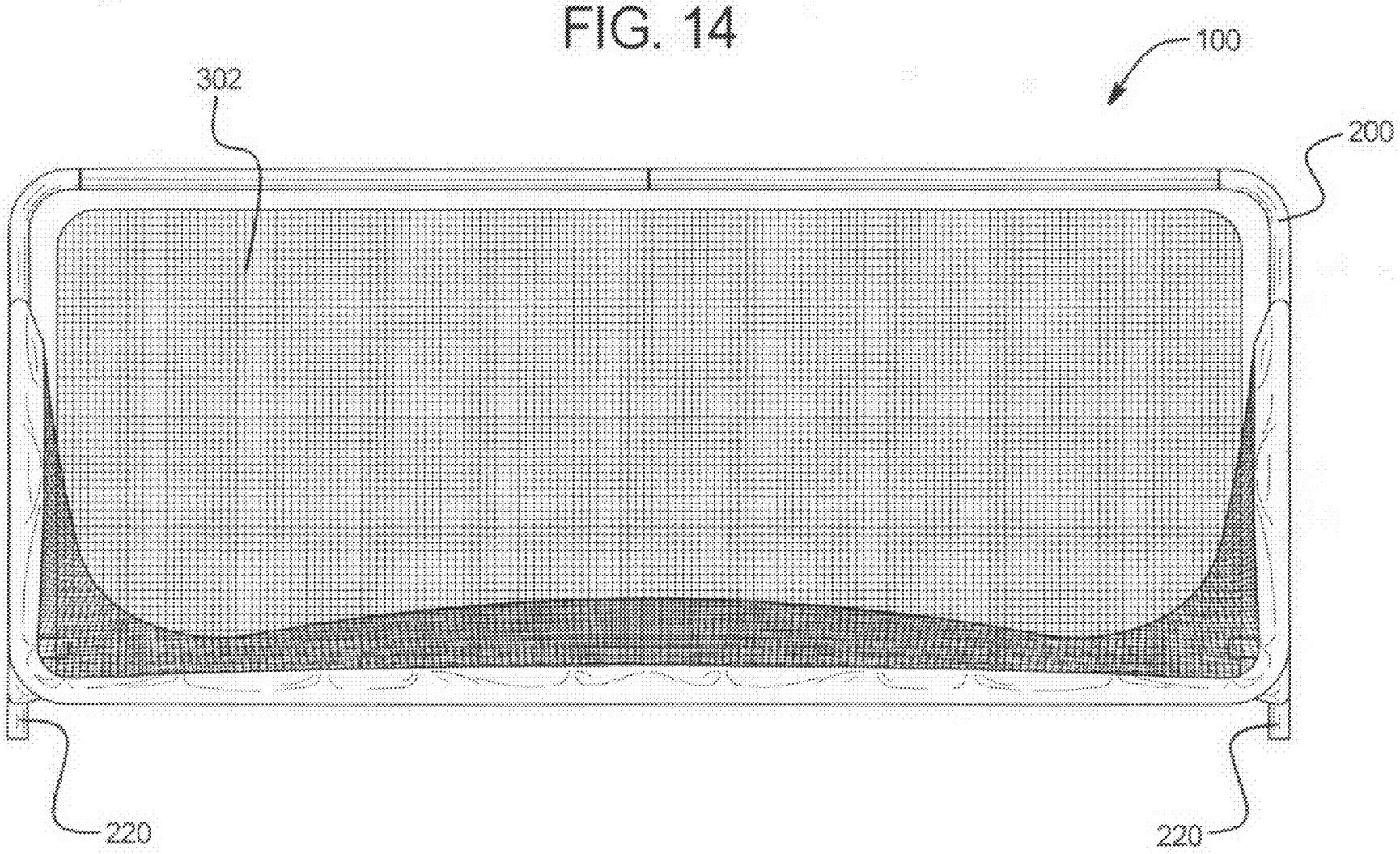
FIG. 14 shows a top view of the multi-sports ball/disk return net system of FIG. 12.
Figure 17:
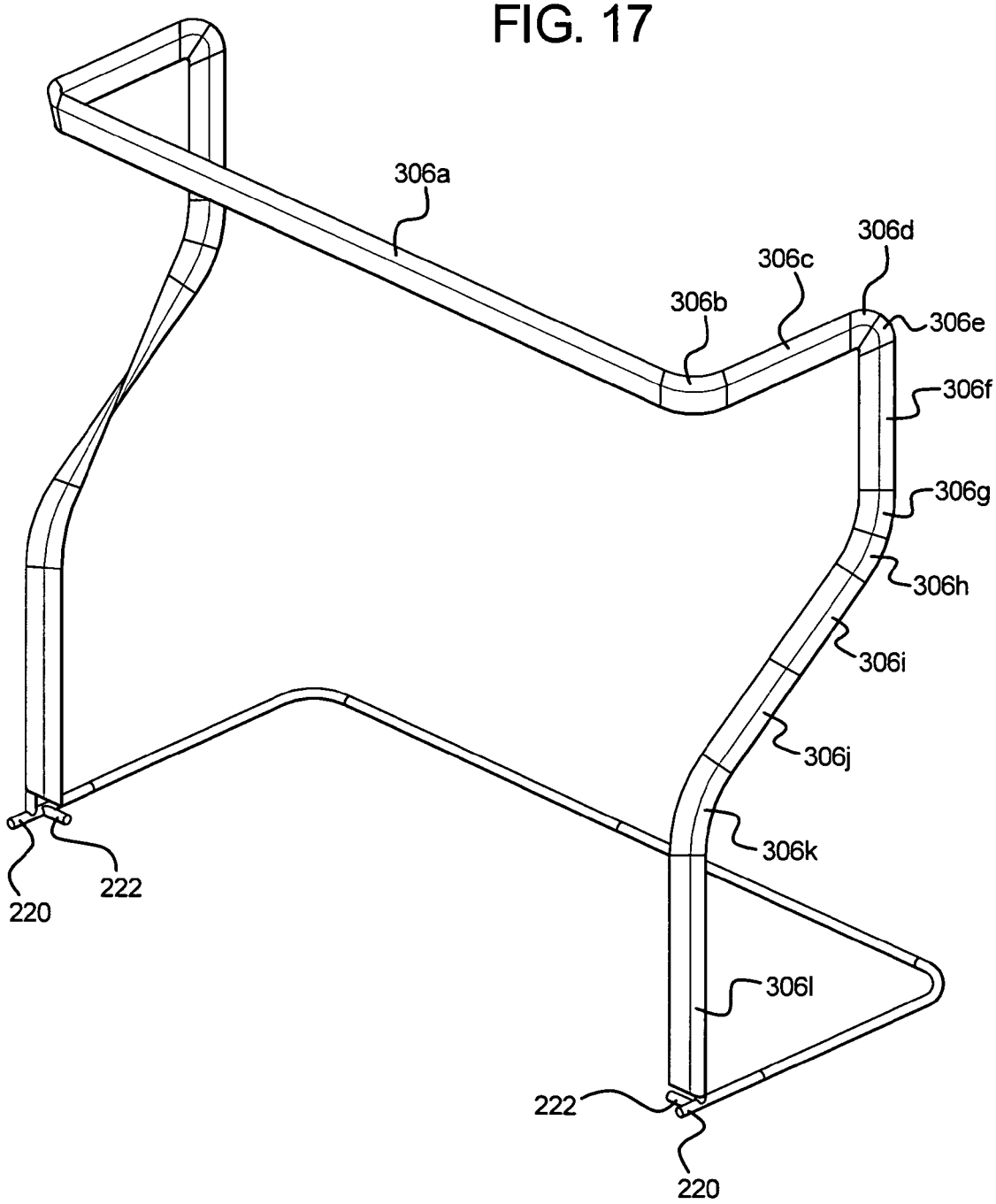
FIG. 17 shows a top perspective view of the frame and sleeve elements of the multi-sports ball/disk return net system of FIG. 12.

As shown in FIG. 17, the upper edge 304 is sized to sleeve and position across the upper front transverse member 28 of the frame 200. The upper portion 301 is sized to sleeve and position across the upper horizontal members 32 and upper vertical members 34 of the frame 200. The middle portion 303 is sized to sleeve and position across the intermediate inclined members 36 and lower vertical members 38 of the frame 200. As shown in FIG. 14, in one embodiment, the lower portion 302 rests on the ground on which the return net system 100 sits. In other embodiments, the lower portion 302 may be fastened or secured to one or more of the lower rearwardly extending horizontal members 42 or 42' and the lower rear transverse member 44.

As shown in FIGS. 13 and 17, sleeve 306 may be constructed from a plurality of sleeve elements 306*a*, 306*b*, 306*c* . . . 306*l*, which may be sewed or otherwise connected together. In one embodiment, each of the sleeve elements 306*a*, 306*b*, 306*c* . . . 306*l*, contains corresponding markers to facilitate correct assembly, alignment and connection to each other. Each of the sleeve elements 306*a*, 306*b*, 306*c* . . . 306*l* is sized and shaped to conform to the position where it is placed with respect to the frame 200 to minimize undesirable movement of the sleeve elements 306*a*, 306*b*, 306*c* . . . 306*l* from its position, which may detract from the optimal functionality of the return net system 100. The sleeve 306 may be made from nylon or other suitable materials. Each sleeve element 306*a*, 306*b*, 306*c* . . . 306*l* may be sewed, or otherwise connected, to the net 300. The upper edge 304 of the net 300 may be connected to sleeve element 306*a* such that a plurality of pleats are produced (see FIG. 18) to create a wave-like (or ruffle) effect to provide additional weight and mass to the net 300 at the U-shape pillow 56' which defines the impact zone. A length of elastic (not shown) may first be sewed or otherwise attached to the upper edge 304 of the net 300 to achieve the pleats or ruffle effect before attaching to the sleeve element 306*a*.

Figure 18:
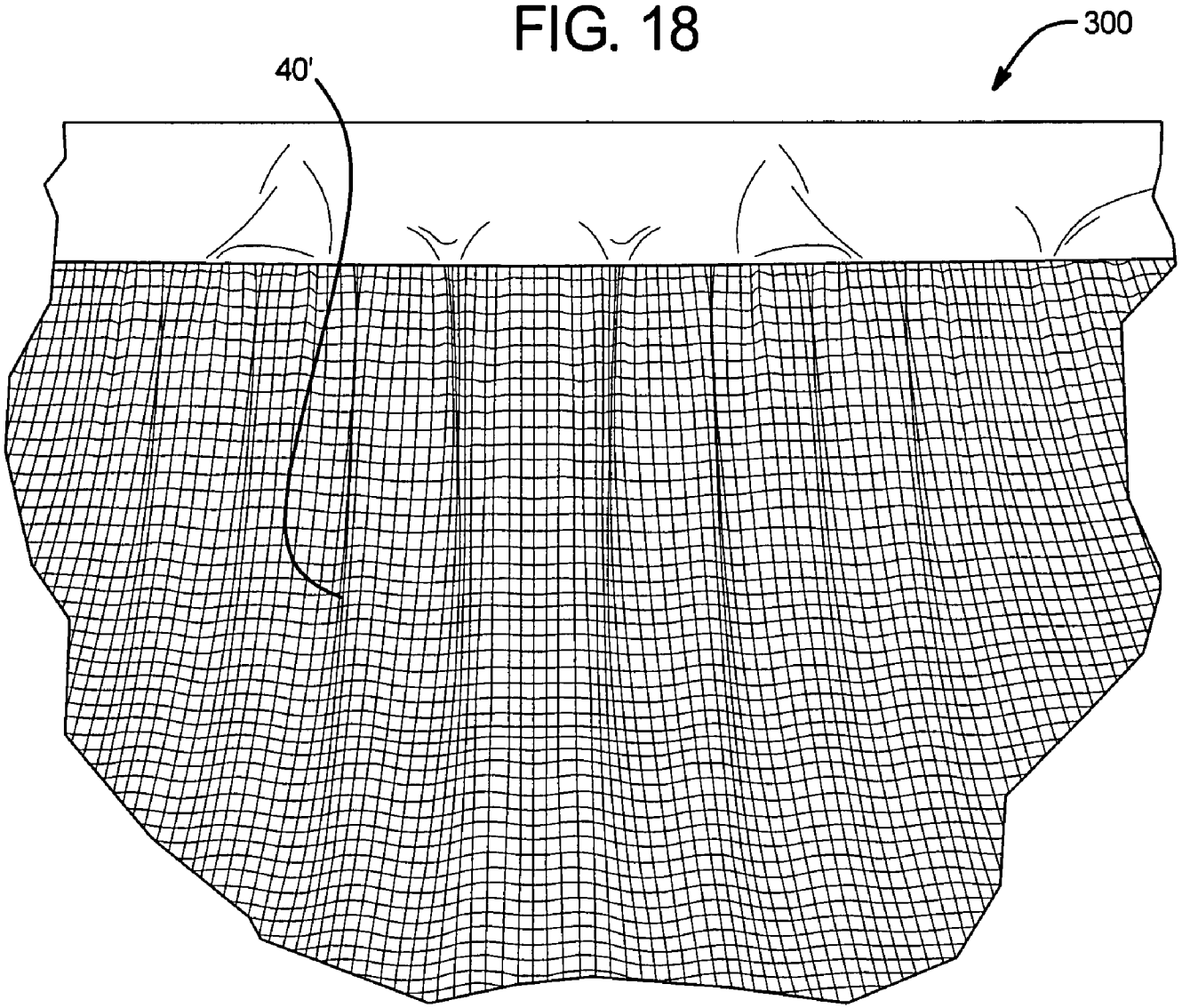
FIG. 18 is a magnified view of the net at the U-shape forward bulging pillow of the multi-sports ball/disk return net system of FIG. 12.
Figure 19:
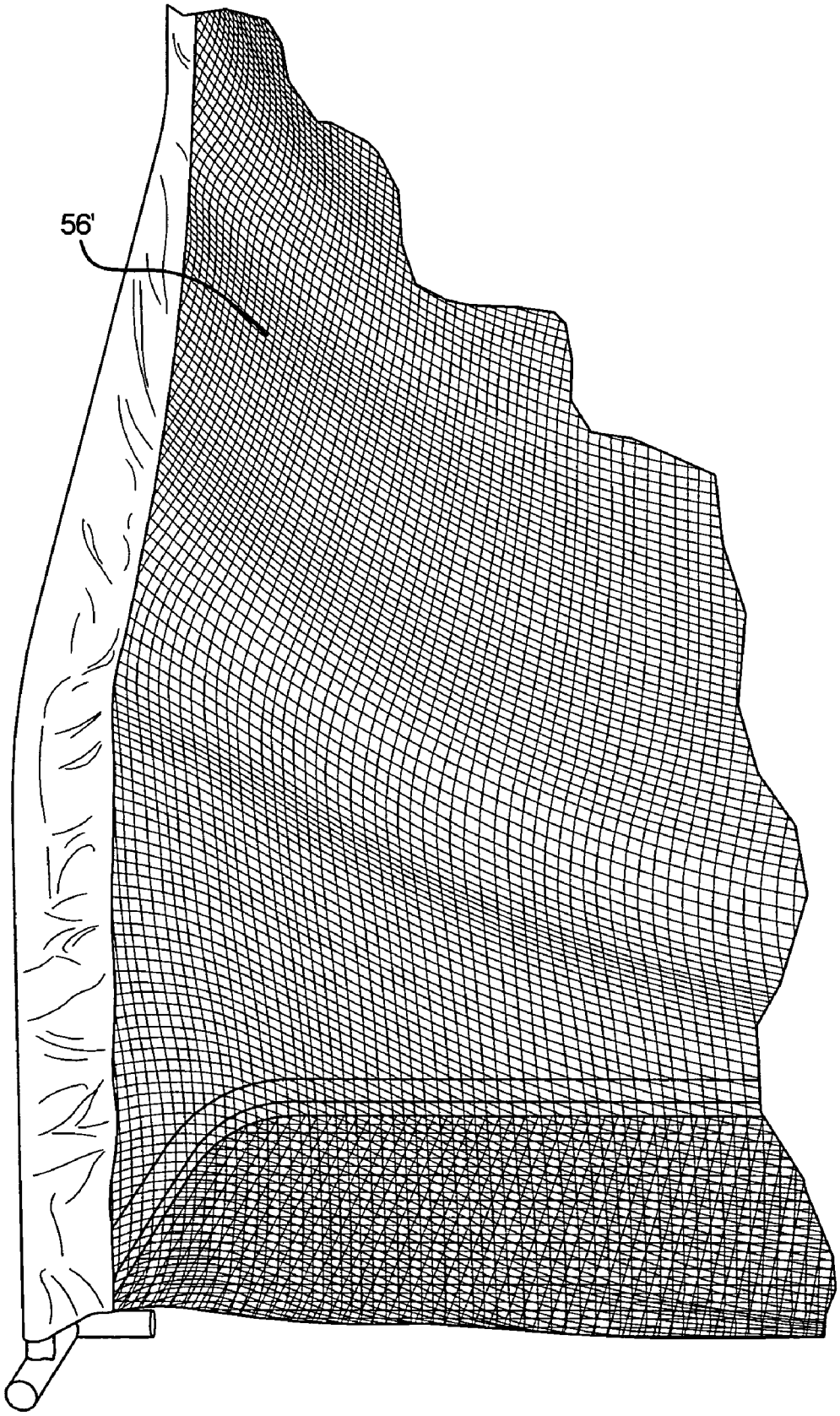
FIG. 19 is a magnified view of the net at the lower U-shape channel or hammock of the multi-sports ball/disk return net system of FIG. 12.

Referring now to FIG. 18, in one embodiment, the net 300 has a square pattern with half-inch (½") square holes. In one embodiment, the net 300 has a weight of approximately 1.1 ounce per square foot. For example, for a frame 200 that is eight feet (8') wide, seven feet and five inches (7'5") high and thirty-six inches (36") deep, the total weight of the net 300 is approximately ten pounds (10 lbs). The heavier gauge of the net 300 effectively counters the impact force from a ball/disk 50' with its mass to properly arrest and then return the ball/disk 50' to the user. In one embodiment, to further increase the effectiveness of arresting a strong forward motion of a ball/disk 50', a resin coating may be applied to the net 300 to increase its stiffness and mass. In one embodiment, the net 300 is made from synthetic material such as polyester. In one embodiment, the plurality of sleeve elements 306*a*, 306*b*, 306*c* . . . 306*l* may be connected to the net 300 in a predetermined arrangement. In one such embodiment, sleeve elements 306*a*, 306*d*, 306*e*, 306*j*, 306*k* and 306*l* are attached to the net 300 in alignment with a horizontal or vertical edge of the square pattern; and sleeve elements 306*b*, 306*c*, 306*f*, 306*g*, 306*h*, and 306*i* are attached to the net 300 in diagonal alignment of the square pattern.

FIGS. 12, 13, 14, and 15 show the return net system 100 with the net 300 mounted on the frame 200. The net 300 forms a U-shape channel or hammock 40' across the pair of intermediate inclined members 36. Above the U-shape channel 40' and below the upper front transverse member 28 is a U-shape forward bulging pillow 56'. The U-shape pillow 56' defines the impact zone of the return net system 100 and the U-shape channel 40' defines the return zone of the return net system 100. Due to the shapes of the net 300 and the frame 200, the U-shape pillow 56' defining the impact zone of the net system 100 is angled slightly backward without the need to use cord 64 and hook 58 of the net system 10 (as in FIG. 11). However, the angle of the impact zone may be further adjusted or fine-tuned with the use of cord 64 and hook 58.

As shown in FIG. 12 and in detail in FIG. 18, the net 300 is hung on a square pattern such that substantially the entire impact zone and the vertical central portion of the net 300 are horizontally and vertically aligned. Horizontal and vertical alignment at the impact zone effectively arrests a ball/disk 50' and minimizes the stretching of the square hole that may allow the ball/disk to pass through. As shown in FIG. 12 and in detail in FIG. 19, the square pattern of the net 300 at opposite ends of the U-shape channel 40' is skewed to become diamond shapes such that a ball/disk 50' dropped into the channel 40' is guided towards the central and lowest point of the U-shape channel 40' for exiting the return net system 100.

The distance between the central and lowest point of the U-shape channel 40' and the ground or surface that supports the return net system 100 may be adjusted by pushing the pair of lower vertical members 38 toward or away from each other. By pushing the pair of lower vertical members 38 toward each other, the distance between the central and lowest point of the U-shape channel 40' and the ground is decreased (by approximately one inch (1") to four inches (4")) to allow a rolling return of the ball/disk 50'. On the other hand, by pushing the pair of lower vertical members 38 away from each other, this distance is increased (by approximately one inch (1") to four inches (4")) to allow a bouncing return of the ball/disk 50'.

In one embodiment the net 30 or 300 has a uniform color. In another embodiment, different portions of the net 30 or 300 have different colors. For example, the U-shape pillow 56 or 56' of the net 30 or 300 may have a different color than the U-shape channel 40 or 40' of the net 30 or 300 to differentiate the impact zone and return zone of the return net system 10 or 100, respectively.

The unique size and shape of the pattern of net 30 or 300 allows the return net system 10 or 100 to be used for a variety of sports balls/disks. The small square holes prevent any ball/disk larger than half-inch (½") from passing through the net 300 and therefore, the return net system 10 or 100 may be used for multiple different sports that utilize a ball/disk/other projectile.

The features of the invention illustrated and described herein is the preferred embodiment. Therefore, it is understood that the appended claims are intended to cover the variations disclosed and unforeseeable embodiments with insubstantial differences that are within the spirit of the claims.

What we claim is:

1. A system for returning a propelled projectile back toward a user who propelled the projectile into the system, comprising:

a frame having an upper portion and two side portions; and a net attachable to said upper and two side portions, said net defining an upper forward bulging portion and a lower generally U-shape channel portion across said two side portions of said frame;

wherein a projectile propelled into said net is discharged from the lowest and central point of said U-shape channel portion back toward the user, and wherein said net having a generally bread shape with a wider bulging upper portion, a wider rectangular lower portion and a narrower tapered middle portion.

2. The system of claim 1 wherein said upper portion of said net is wider than said lower portion of said net.

3. The system of claim 1 wherein said net further having an upper edge and a lower edge that are substantially parallel to each other and of substantially the same width.

4. The system of claim 3 wherein said upper and middle portions and said upper edge of said net having a continuous sleeve for attaching to said upper and two sides portions of said frame.

5. The system of claim 4 wherein said sleeve includes a plurality of sleeve elements connected together.

6. The system of claim 5 wherein each of said sleeve element is shaped and sized to be sleeved across said upper portion and two side portions of said frame to minimize undesirable movement of the sleeve elements from its position on said frame.

7. The system of claim 1 wherein said frame further having a lower portion configured to support said frame in an upright position.

8. The system of claim 1 wherein said each side portion of said frame is substantially S-shaped.

9. The system of claim 1 wherein said frame comprises a plurality of tubular elements which are interconnectable to each other to form said frame.

10. The system of claim 9 wherein said frame further comprises means for interconnecting said plurality of tubular elements to each other.

11. The system of claim 10 wherein said interconnecting means comprises a tapered end and a non-tapered end at each tubular element, said tapered end of each said tubular element is configured to be inserted into said non-tapered end of another one of the tubular elements.

12. The system of claim 11 wherein said interconnecting means further comprises a pushbutton at said tapered end and an opening at said non-tapered end of each tubular element, said pushbutton is configured to be snapped into said opening upon the insertion of said tapered end of one of said tubular elements into said non-tapered end of another one of the tubular elements.

13. The system of claim 12 wherein said frame further comprises means for facilitating interconnection of said plurality of tubular elements.

14. The system of claim 13 wherein said facilitating means comprises a plurality of matching indicia at corresponding ends of each pair of tubular elements that are to be interconnected.

15. The system of claim 14 wherein said plurality of matching indicia includes a plurality of matching colors.

16. The system of claim 9 wherein said plurality of tubular elements include fourteen tubular elements.

17. The system of claim 4 wherein said upper portion of said frame comprises:

an upper front transverse member having a first end and a second end, and first and second upper rearwardly extending horizontal members, each of said upper rearwardly extending horizontal members having a first end and a second end, wherein the first end of said upper front transverse member is interconnectable to the first end of said first upper rearwardly extending horizontal member and the second end of said upper front transverse member is interconnectable to the first end of said second upper rearwardly extending horizontal member.

18. The system of claim 17 wherein each side portion of said frame comprises:

an upper downwardly extending vertical member having a first end and a second end, an intermediate downwardly extending and forwardly inclined member having a first end and a second end, and a lower downwardly extending vertical member having a first end and a second end, wherein the second end of said first or second upper rearwardly extending horizontal member is interconnectable to the first end of said upper downwardly extending vertical member, the second end of said upper downwardly extending vertical member is interconnectable to the first end of said intermediate downwardly extending and forwardly inclined member, and the second end of said intermediate downwardly extending and forwardly inclined member is interconnectable to the first end of said lower downwardly extending vertical member.

19. The system of claim 18 wherein said frame further comprises a lower portion configured to support said frame in an upright position, said lower portion comprises:

first and second lower rearwardly extending horizontal members, each of said lower rearwardly extending horizontal members having a first end and a second end, a lower rear transverse member having a first end and a second end, wherein the second end of each of said lower downwardly extending vertical members is interconnectable to said first end one said first or second lower rearwardly extending horizontal members, and the second end of each of said first or second lower rearwardly extending horizontal members is interconnectable to said first and second ends of said lower rear transverse member.

20. The system of claim 19 wherein said upper edge of said net is configured to be sleeved and positioned across said upper front transverse member of said frame, said upper portion of said net is configured to be sleeved and positioned across said first and second upper rearwardly extending horizontal members and said first and second upper downwardly extending vertical members of said frame, and said middle portion of said net is configured to be sleeved and positioned across said first and second intermediate downwardly extending and forwardly inclined members and said first and second lower downwardly extending vertical members of said frame.

21. The system of claim 1 wherein said net further having a plurality of pleats at said upper forward bulging portion to provide a ruffle effect.

22. The system of claim 1 wherein said net having a square pattern of ½" square holes.

23. The system of claim 1 wherein said net having a weight of approximately 1.1 ounce per square foot.

24. The system of claim 1 wherein said net further having a resin coating applied thereon.

25. The system of claim 1 wherein said net having a square pattern, said square pattern being horizontally and vertically aligned at said upper forward bulging portion of said net, and said square pattern being skewed to become diamond shapes at opposite ends of said lower generally U-shape channel portion of said net.

26. The system of claim 18 wherein each side portion of said frame further comprises a forward extending horizontal element to provide additional forward stability to the system.

27. The system of claim 26 wherein said forward extending horizontal element extends from said lower downwardly extending vertical member.

28. The system of claim 18 wherein each side portion of said frame further comprises a transversely extending horizontal element to provide additional support to reduce swaying of said frame.

29. The system of claim 28 wherein said transversely extending horizontal element extends from said first and second lower downwardly extending vertical members.

30. The system of claim 19 wherein said first and second upper rearwardly extending horizontal members are shorter than said first and second lower rearwardly extending horizontal members.

31. The system of claim 1 wherein said upper forward bulging portion of said net is angled in a rearward direction.

32. A system for returning a propelled projectile back toward a user who propelled the projectile into the system, comprising:

a frame which includes:

an upper front transverse member having a first end and a second end, and first and second upper rearwardly extending horizontal members, each of said upper rearwardly extending horizontal members having a first end and a second end, first and second upper downwardly extending vertical members, each upper downwardly extending vertical member having a first end and a second end, first and second intermediate downwardly extending and forwardly inclined members, each intermediate downwardly extending and forwardly inclined member having a first end and a second end, and first and second lower downwardly extending vertical members, each lower downwardly extending vertical member having a first end and a second end, first and second lower rearwardly extending horizontal members, each of said lower rearwardly extending horizontal members having a first end and a second end, a lower rear transverse member having a first end and a second end, wherein the first end of said upper front transverse member is interconnectable to the first end of said first upper rearwardly extending horizontal member and the second end of said upper front transverse member is interconnectable to the first end of said second upper rearwardly extending horizontal member, each second end of said first and second upper rearwardly extending horizontal members is interconnectable to each first end of said first and second upper downwardly extending vertical members, each second end of said first and second upper downwardly extending vertical members is interconnectable to each first end of said first and second intermediate downwardly extending and forwardly inclined members, each second end of said first and second intermediate downwardly extending and forwardly inclined members is interconnectable to each first end of said first and second lower downwardly extending vertical members, each second end of said first and second lower downwardly extending vertical members is interconnectable to each first end of said first and second lower rearwardly extending horizontal members, the second end of said first lower rearwardly extending horizontal member is interconnectable to said first end of said lower rear transverse member, and the second end of said second lower rearwardly extending horizontal member is interconnectable to said second end of said lower rear transverse member; and a net defining an upper forward bulging portion and a lower generally U-shape channel portion, having a generally bread shape with a wider bulging upper portion, a wider rectangular lower portion, a narrower tapered middle portion, and an upper edge and a lower edge that are substantially parallel to each other and of substantially the same width, wherein said upper edge of said net is configured to be sleeved and positioned across said upper front transverse member of said frame, said upper portion of said net is configured to be sleeved and positioned across said first and second upper rearwardly extending horizontal members and said first and second upper downwardly extending vertical members of said frame, and said middle portion of said net is configured to be sleeved and positioned across said first and second intermediate downwardly extending and forwardly inclined members and said first and second lower downwardly extending vertical members of said frame, such that a projectile propelled into said net is discharged from the lowest and central point of said U-shape channel portion back toward the user.

33. A method of returning a propelled projectile back toward a user who propelled the projectile, comprising the steps of:

providing a frame having an upper portion and two side portions;

providing a net having a generally bread shape with a wider bulging upper portion, a wider rectangular lower portion, a narrower tapered middle portion, and an upper edge and a lower edge that are substantially parallel to each other and of substantially the same width, attachable to said upper and two side portions of said frame and defining an upper forward bulging portion that is angled in a rearward direction and a lower generally U-shape channel portion across said two side portions of said frame;

absorbing the energy of a projectile propelled into said upper forward bulging portion of said net, with said net moving in the direction of the propelled projectile;

returning the net to its original position allowing the projectile to move in the direction opposite its propelled direction and into said lower generally U-shape channel portion of said net; and discharging the projectile at the lowest and central point of said U-shape channel portion of said net back toward the user.

34. The method of claim 33 wherein said upper portion of said frame comprises:

an upper front transverse member having a first end and a second end, and first and second upper rearwardly extending horizontal members, each of said upper rearwardly extending horizontal members having a first end and a second end, wherein the first end of said upper front transverse member is interconnectable to the first end of said first upper rearwardly extending horizontal member and the second end of said upper front transverse member is interconnectable to the first end of said second upper rearwardly extending horizontal member.

35. The method of claim 34 wherein each side portion of said frame comprises:

an upper downwardly extending vertical member having a first end and a second end, an intermediate downwardly extending and forwardly inclined member having a first end and a second end, and a lower downwardly extending vertical member having a first end and a second end, wherein the second end of said first or second upper rearwardly extending horizontal member is interconnectable to the first end of said upper downwardly extending vertical member, the second end of said upper downwardly extending vertical member is interconnectable to the first end of said intermediate downwardly extending and forwardly inclined member, and the second end of said intermediate downwardly extending and forwardly inclined member is interconnectable to the first end of said lower downwardly extending vertical member.

36. The method of claim 35 wherein said frame further comprises a lower portion configured to support said frame in an upright position, said lower portion comprises:

first and second lower rearwardly extending horizontal members, each of said lower rearwardly extending horizontal members having a first end and a second end, a lower rear transverse member having a first end and a second end, wherein the second end of each of said lower downwardly extending vertical members is interconnectable to said first end one said first or second lower rearwardly extending horizontal members, and the second end of each of said first or second lower rearwardly extending horizontal members is interconnectable to said first and second ends of said lower rear transverse member.

37. The method of claim 36 wherein said upper edge of said net is configured to be sleeved and positioned across said upper front transverse member of said frame, said upper portion of said net is configured to be sleeved and positioned across said first and second upper rearwardly extending horizontal members and said first and second upper downwardly extending vertical members of said frame, and said middle portion of said net is configured to be sleeved and positioned across said first and second intermediate downwardly extending and forwardly inclined members and said first and second lower downwardly extending vertical members of said frame.

38. The method of claim 33 wherein said net having a square pattern of ½" square holes.

39. The method of claim 33 wherein said lowest and central point of said U-shape channel is at a predetermined distance from a surface on which said frame is placed, further comprising the steps of:

pushing said two side portions of said frame toward each other to decrease said predetermined distance between said lowest and central point of said U-shape channel from the ground.

40. The method of claim 33 wherein said lowest and central point of said U-shape channel is at a predetermined distance from the surface on which said frame is placed, further comprising the steps of:

pushing said two side portions of said frame away from each other to increase said predetermined distance between said lowest and central point of said U-shape channel from the ground.

41. A system for returning a propelled projectile back toward a user who propelled the projectile into the system, comprising:

a frame; and a net mounted across and on said frame, said net defining an upper forward bulging impact portion, a middle generally U-shape channel return portion and a lower non-impact portion, wherein a projectile propelled into said upper forward bulging impact portion of said net is discharged from the lowest and central point of said U-shape channel return portion back toward the user, and a projectile propelled into said lower non-impact portion is trapped therein.

42. The system of claim 41 wherein said net having a generally bread shape with a wider bulging upper portion, a wider rectangular lower portion, a narrower tapered middle portion, and an upper edge and a lower edge that are substantially parallel to each other and of substantially the same width.

43. The system of claim 42 wherein said frame having:

an upper front transverse member having a first end and a second end, first and second upper rearwardly extending horizontal members, each of said upper rearwardly extending horizontal members having a first end and a second end, first and second upper downwardly extending vertical members, each upper downwardly extending vertical member having a first end and a second end, first and second intermediate downwardly extending and forwardly inclined members, each intermediate downwardly extending and forwardly inclined member having a first end and a second end, and first and second lower downwardly extending vertical members, each lower downwardly extending vertical member having a first end and a second end, wherein the first end of said upper front transverse member is interconnectable to the first end of said first upper rearwardly extending horizontal member and the second end of said upper front transverse member is interconnectable to the first end of said second upper rearwardly extending horizontal member, each second end of said first and second upper rearwardly extending horizontal members is interconnectable to each first end of said first and second upper downwardly extending vertical members, each second end of said first and second upper downwardly extending vertical members is interconnectable to each first end of said first and second intermediate downwardly extending and forwardly inclined members, each second end of said first and second intermediate downwardly extending and forwardly inclined members is interconnectable to each first end of said first and second lower downwardly extending vertical members, wherein said upper edge of said net is configured to be sleeved and positioned across the upper front transverse member of said frame, said upper portion of said net is configured to be sleeved and positioned across said first and second upper rearwardly extending horizontal members and said first and second upper downwardly extending vertical members of said frame, and said middle portion of said net is configured to be sleeved and positioned across said first and second intermediate downwardly extending and forwardly inclined members and said first and second lower downwardly extending vertical members of said frame.

44. The system of claim 41 wherein said net further having a plurality of pleats at said upper forward bulging portion to provide a ruffle effect.

45. The system of claim 41 wherein said net having a square pattern of ½" square holes.

46. The system of claim 41 wherein said net having a weight of approximately 1.1 ounce per square foot.

47. The system of claim 41 wherein said net further having a resin coating applied thereon.

48. The system of claim 41 wherein said net having a square pattern, said square pattern being horizontally and vertically aligned at said upper forward bulging portion of said net, and said square pattern being skewed to become diamond shapes at opposite ends of said middle generally U-shape channel portion of said net.

49. The system of claim 41 wherein said upper forward bulging portion of said net is angled in a rearward direction.

* * * * *